US009908605B2

(12) United States Patent
Hayashi et al.

(10) Patent No.: US 9,908,605 B2
(45) Date of Patent: Mar. 6, 2018

(54) SHIP STEERING SYSTEM FOR OUTDRIVE DEVICE

(71) Applicant: YANMAR CO., LTD., Osaka-shi, Osaka (JP)

(72) Inventors: Akiyoshi Hayashi, Osaka (JP); Naohiro Hara, Osaka (JP); Jun Watanabe, Osaka (JP); Junichi Hitachi, Osaka (JP)

(73) Assignee: YANMAR CO., LTD., Osaka-Shi, Osaka (JP)

( * ) Notice: Subject to any disclaimer, the term of this patent is extended or adjusted under 35 U.S.C. 154(b) by 0 days.

(21) Appl. No.: 15/115,022

(22) PCT Filed: Jan. 30, 2014

(86) PCT No.: PCT/JP2014/052127
§ 371 (c)(1),
(2) Date: Jul. 28, 2016

(87) PCT Pub. No.: WO2015/114781
PCT Pub. Date: Aug. 6, 2015

(65) Prior Publication Data
US 2016/0340013 A1 Nov. 24, 2016

(51) Int. Cl.
*B63H 25/42* (2006.01)
*B63H 25/02* (2006.01)
*B63H 21/21* (2006.01)

(52) U.S. Cl.
CPC ..... *B63H 25/42* (2013.01); *B63H 21/213* (2013.01); *B63H 25/02* (2013.01); *B63H 2021/216* (2013.01)

(58) Field of Classification Search
CPC ..... B63H 21/213; B63H 25/02; B63H 25/42
See application file for complete search history.

(56) References Cited

U.S. PATENT DOCUMENTS 3,695,205 A * 10/1972 Thomas ..... G05D 1/0206 114/144 R
6,397,655 B1 6/2002 Stephenson
(Continued)

FOREIGN PATENT DOCUMENTS

JP H06219390 A 8/1994
JP H08142992 6/1996
(Continued)

OTHER PUBLICATIONS

International Search Report corresponding to Application No. PCT/JP2014/052127; dated Apr. 28, 2014, with English translation.

*Primary Examiner* — Rodney A Butler
(74) *Attorney, Agent, or Firm* — Cantor Colburn LLP

(57) ABSTRACT

Provided is a technology that facilitates a calibrating operation. A ship steering system for outdrive device includes an outdrive device, a control device that provides an instruction about a turning direction of the outdrive device, and a ship steering lever that instructs the control device about a traveling direction of a hull, and is provided with a monitor capable of displaying an image for matching an actual traveling direction with the traveling direction of the hull according to the instruction from the ship steering lever. The monitor shows the direction in which the ship steering lever is tipped, and indicates that the operation is proper if the direction in which the ship steering lever is tipped corresponds to a pre-set direction.

20 Claims, 25 Drawing Sheets

(56) References Cited

U.S. PATENT DOCUMENTS

| | | | | |
|---|---|---|---|---|
| 8,862,293 | B2 * | 10/2014 | Hara | B63H 25/42 701/21 |
| 2003/0019414 | A1 | 1/2003 | Borrett | |
| 2005/0159052 | A1 | 7/2005 | Borrett | |
| 2009/0004930 | A1 * | 1/2009 | Larsson | B63H 21/213 440/1 |
| 2009/0281685 | A1 * | 11/2009 | Larsson | B63H 21/213 701/21 |
| 2011/0088384 | A1 | 4/2011 | Smith | |
| 2011/0166724 | A1 | 7/2011 | Hiramatsu | |
| 2014/0156124 | A1 | 6/2014 | Hara et al. | |
| 2014/0364018 | A1 | 12/2014 | Hara et al. | |

FOREIGN PATENT DOCUMENTS

| | | | |
|---|---|---|---|
| JP | H107090 | A | 1/1998 |
| JP | 2000289693 | A | 10/2000 |
| JP | 2001001992 | A | 1/2001 |
| JP | 2001317503 | A | 11/2001 |
| JP | 2011140272 | A | 7/2011 |
| JP | 2011246052 | A | 12/2011 |
| JP | 2013014173 | A | 1/2013 |
| JP | 2014046847 | A | 3/2014 |
| JP | 2014046864 | A | 3/2014 |
| JP | 2014046865 | A | 3/2014 |

* cited by examiner

SHIP STEERING SYSTEM FOR OUTDRIVE DEVICE

CROSS REFERENCE TO RELATED APPLICATIONS

This is the U.S. national stage of application No. PCT/JP2014/052127, filed on Jan. 30, 2014, the disclosure of which is incorporated herein by reference.

TECHNICAL FIELD

The present invention relates to an art of a ship steering system for an outdrive device.

BACKGROUND ART

Conventionally, an inboard engine (inboard engine-outboard drive) in which an engine is arranged inside a hull and power is transmitted to an outdrive device arranged outside the hull is known (for example, see the Patent Literature 1). The outdrive device is a propulsion device propelling the hull by rotating a screw propeller. The outdrive device is also a rudder device which is rotated concerning a traveling direction of the hull so as to turn the hull.

In addition to the outdrive device, a ship steering system for the outdrive device has a control device instructing a rotation direction of the outdrive device and an operation lever instructing a traveling direction of a hull to a control device. The ship steering system for the outdrive device has a calibration function for adjusting an actual traveling direction to the traveling direction of the hull instructed by the operation lever. Work adjusting the actual traveling direction to the traveling direction of the hull instructed by the operation lever is referred to as calibration work.

PRIOR ART REFERENCE

Patent Literature

Patent Literature 1: the Japanese Patent Laid Open Gazette 2011-246052

DISCLOSURE OF INVENTION

Problems to be Solved by the Invention

The purpose of the present invention is to provide an art making calibration work easy.

Means for Solving the Problems

The problems to be solved by the present invention have been described above, and subsequently, the means of solving the problems will be described below.

According to the present invention, a ship steering system for an outdrive device has the outdrive device, a control device instructing a rotation direction of the outdrive device, an operation lever instructing a traveling direction of a hull to the control device, and a monitor which can display an image for adjusting an actual traveling direction to the traveling direction of the hull instructed by the operation lever. The monitor shows a direction along which the operation lever is moved, and when the direction along which the operation lever is moved is in agreement with a direction set preferably, shows purport that the operation is proper.

According to the present invention, the monitor shows a direction along which the operation lever should be moved, and when the operation lever is moved to the shown direction, shows purport that the operation is proper.

According to the present invention, the monitor shows a direction along which the operation lever should be moved by a range of predetermined angle centering on a fulcrum of the operation lever, and when the operation lever is moved along the shown range, shows purport that the operation is proper.

According to the present invention, when a gap exists between the traveling direction of the hull instructed by the operation lever and the actual traveling direction, the monitor shows the direction along which the operation lever should be moved which is collected so as to cancel the gap.

According to the present invention, when a gap exists between the traveling direction of the hull instructed by the operation lever and the actual traveling direction, the monitor collects the rotation direction of the outdrive device so as to cancel the gap and shows purport that the collection is finished.

According to the present invention, the monitor shows the image of parallel movement, and subsequently shows the image of skid movement.

Effect of the Invention

The present invention configured as the above brings the following effects.

According to the present invention, the monitor shows the direction along which the operation lever is moved, and when the direction along which the operation lever is moved is in agreement with the direction set preferably, shows the purport that the operation is proper. Accordingly, an operator can perform the operation while confirming the direction along which the operation lever is moved and can confirm the purport that the operation is proper. Therefore, the calibration work can be performed easily.

According to the present invention, the monitor shows the direction along which the operation lever should be moved, and when the operation lever is moved to the shown direction, shows the purport that the operation is proper. Accordingly, an operator can operate the operation lever without hesitation and recognize the purport that the operation is proper. Therefore, the calibration work can be performed easily.

According to the present invention, the monitor shows the direction along which the operation lever should be moved by the range of predetermined angle centering on the fulcrum of the operation lever, and when the operation lever is moved along the shown range, shows the purport that the operation is proper. Accordingly, an operator can operate the operation lever without being too careful and can recognize the purport that the operation is proper. Therefore, the calibration work can be performed easily.

According to the present invention, when the gap exists between the traveling direction of the hull instructed by the operation lever and the actual traveling direction, the monitor shows the direction along which the operation lever should be moved which is collected so as to cancel the gap. Accordingly, an operator can make the traveling direction of the hull instructed by the operation lever in agreement with the actual traveling direction accurately. Therefore, the calibration work can be performed easily.

According to the present invention, when the gap exists between the traveling direction of the hull instructed by the operation lever and the actual traveling direction, the monitor collects the rotation direction of the outdrive device so as to cancel the gap and shows the purport that the collection is finished. Accordingly, an operator can make the traveling direction of the hull instructed by the operation lever in agreement with the actual traveling direction accurately. Therefore, the calibration work can be performed easily.

According to the present invention, the monitor shows the image of parallel movement, and subsequently shows the image of skid movement. Accordingly, an operator can perform correctly the calibration work without mistaking the order. Therefore, the calibration work can be performed easily.

DETAILED DESCRIPTION OF THE INVENTION

Firstly, outline and a configuration of a ship steering system 100 for an outdrive device is explained.

Figure 1:
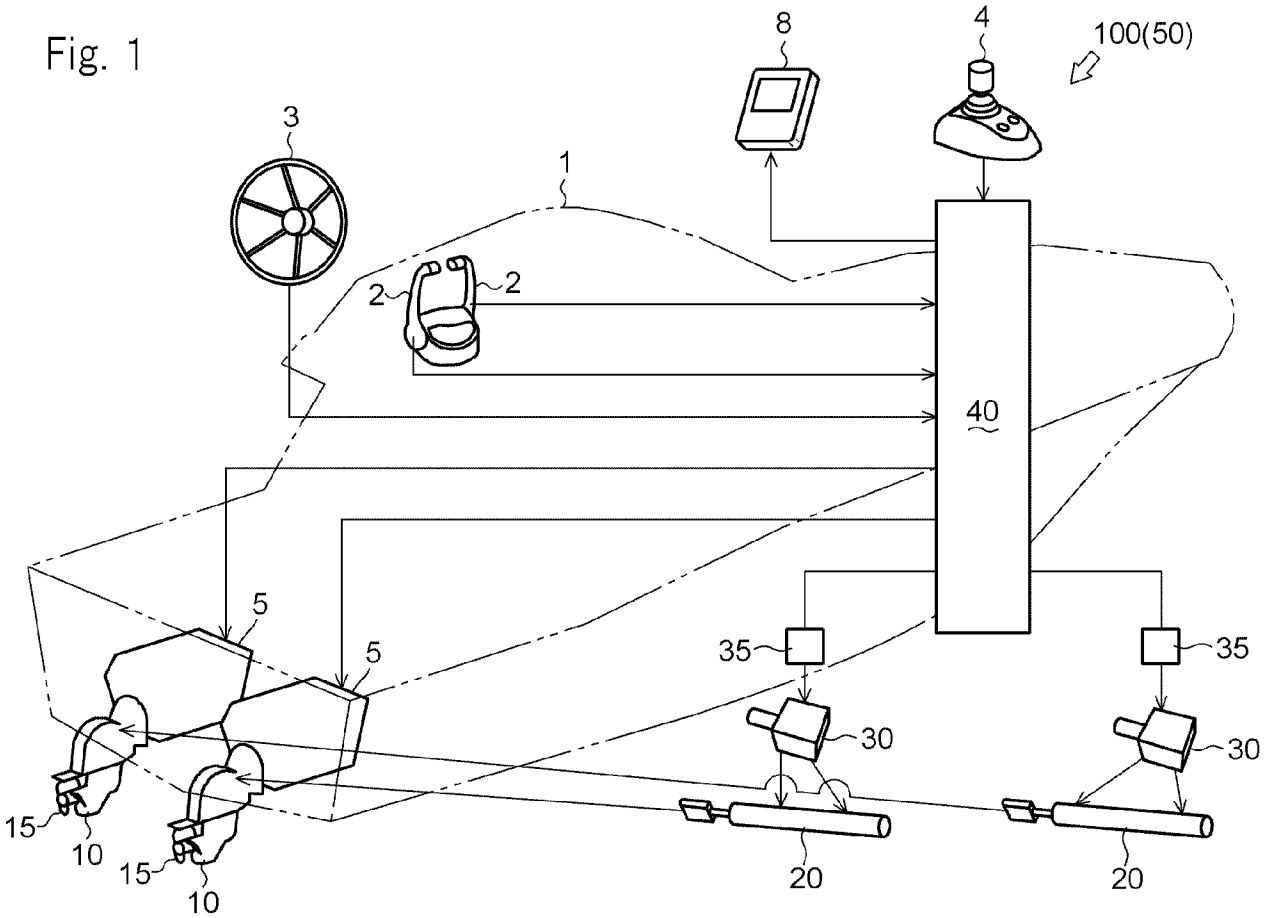
FIG. 1 is a drawing of an outline of a ship steering system for an outdrive device.
Figure 2:
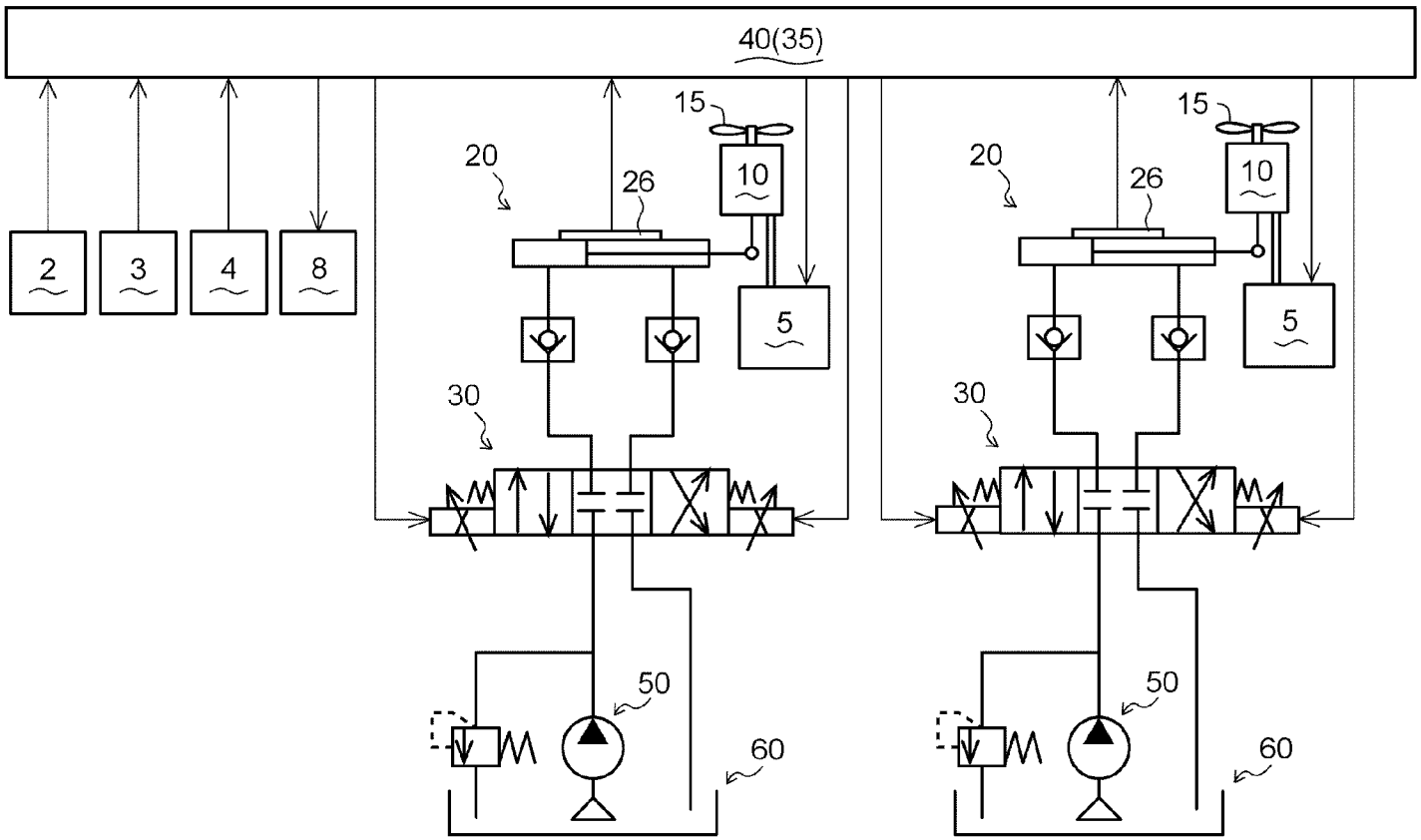
FIG. 2 is a drawing of a configuration of the ship steering system for the outdrive device.
Figure 3:
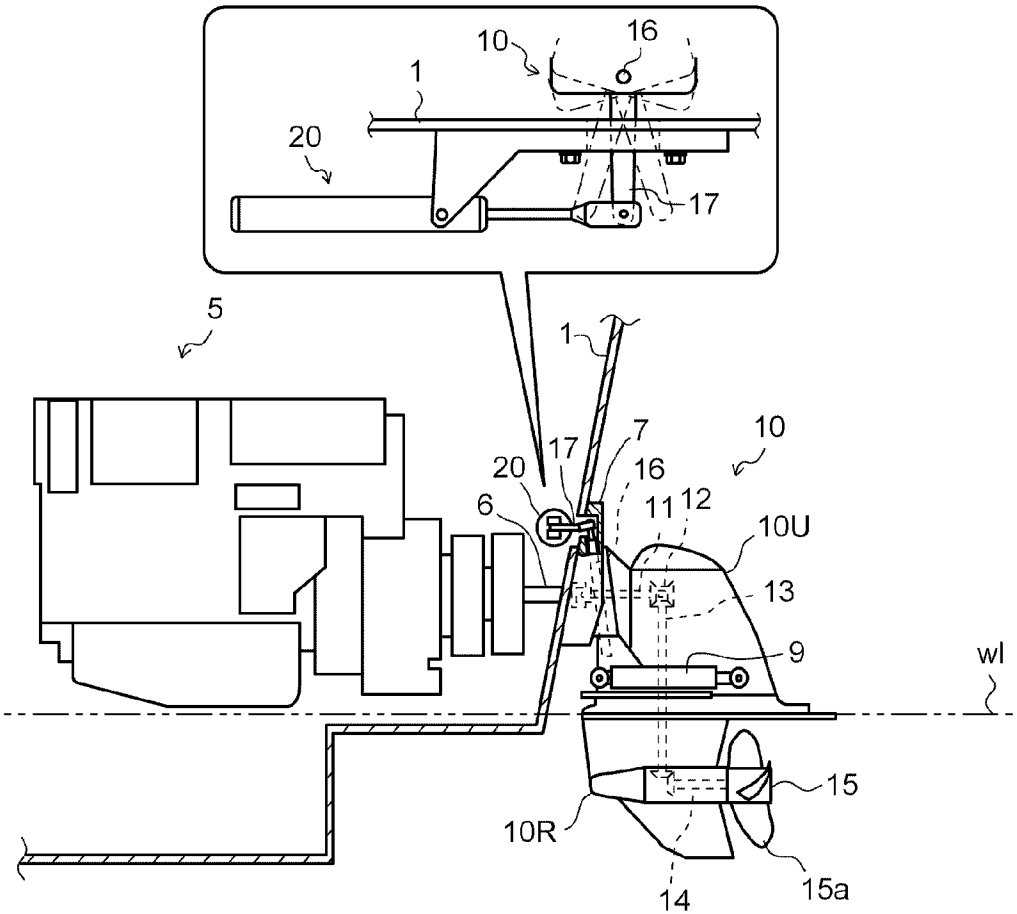
FIG. 3 is a drawing of a configuration of the outdrive device.

FIG. 1 is a drawing of an outline of the ship steering system 100 for the outdrive device. FIG. 2 is a drawing of a configuration of the ship steering system 100 for the outdrive device. FIG. 3 is a drawing of a configuration of the outdrive device 10. The ship steering system 100 for the outdrive device is used for a so-called biaxial propulsion ship which has the two outdrive devices 10.

The ship steering system 100 for the outdrive device can control driving state of an engine 5 corresponding to operation of a throttle lever 2, and as a result, rotation speed of a screw propeller 15 can be changed. The ship steering system 100 can change rotation angle of the outdrive device 10 corresponding to operation of a steering wheel 3 and an operation lever 4. In addition to the operation lever (hereinafter, referred to as "joystick") 4, the ship steering system 100 includes the outdrive device 10, a steering hydraulic actuator 20, an electromagnetic proportional valve 30 and a control device 40.

The outdrive device 10 propels the hull 1 by rotating the screw propeller 15. The outdrive device 10 turns the hull 1 by rotating itself concerning the hull 1. The outdrive device 10 includes an input shaft 11, a switching clutch 12, a drive shaft 13, an output shaft 14 and the screw propeller 15.

The input shaft 11 transmits rotation power of the engine 5, transmitted via a universal joint 6, to the switching clutch 12. One of ends of the input shaft 11 is connected to the universal joint 6 attached to an output shaft of the engine 5, and the other end thereof is connected to the switching clutch 12 arranged inside an upper housing 10U.

The switching clutch 12 can switch the rotation power of the engine 5, transmitted via the input shaft 11 and the like, to forward or reverse direction. The switching clutch 12 has a forward bevel gear and a reverse bevel gear which are connected to an inner drum having disc plates, and the rotation direction is changed according to whether one of the disc plates is pressed by a pressure plate of an outer drum connected to the input shaft 11.

The drive shaft 13 transmits the rotation power of the engine 5, transmitted via the switching clutch 12 and the like, to the output shaft 14. A bevel gear provided at one of ends of the drive shaft 13 is meshed with the forward bevel gear and the reverse bevel gear provided in the switching clutch 12, and a bevel gear provided at the other end is meshed with a bevel gear provided on the output shaft 14 arranged inside a lower housing 10R.

The output shaft 14 transmits the rotation power of the engine 5, transmitted via the drive shaft 13 and the like, to the screw propeller 15. As mentioned above, the bevel gear provided at one of ends of the output shaft 14 is meshed with the bevel gear of the drive shaft 13, and the other end is attached thereto with the screw propeller 15.

The screw propeller 15 is rotated so as to generate propulsion power. The screw propeller 15 is driven by the rotation power of the engine 5 transmitted via the output shaft 14 and the like so that a plurality of blades 15*a* arranged around a rotation shaft paddle surrounding water, whereby the propulsion power is generated.

The outdrive device 10 is supported by a gimbal housing 7 attached to a stern board (transom board) of the hull 1. Concretely, the outdrive device 10 is supported by the gimbal housing 7 so as to make a gimbal ring 16 of the outdrive device 10 substantially perpendicular to a waterline w1. The gimbal ring 16 is a substantially cylindrical rotation shaft attached to the outdrive device 10, and the outdrive device 10 is rotated centering on the gimbal ring 16.

A steering arm 17 extended into the hull 1 is attached to an upper end of the gimbal ring 16. The steering arm 17 rotates the outdrive device 10 centering on the gimbal ring 16. The steering arm 17 is driven by the steering hydraulic actuator 20. The steering hydraulic actuator 20 is driven by the electromagnetic proportional valve 30 interlocked with operation of the steering wheel 3 and the joystick 4.

Next, action of the hull 1 at the time of operating the joystick 4 is explained.

FIGS. 4A-4D and 5A-5D show the action of the hull 1 at the time of operating the joystick 4. A direction of an arrow P in each of the drawings shows a traveling direction of the hull 1, and a direction of an arrow F in each of the drawings shows a direction of a propulsion power generated by the outdrive device 10. The outdrive device 10 at the right side is referred to as a right outdrive device 10R, and the outdrive device 10 at the left side is referred to as a left outdrive device 10L.

Figure 4A:
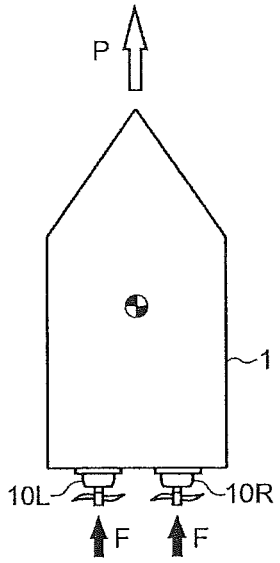
FIGS. 4A-4D are drawings of action of a hull when a steering lever is operated.
Figure 4B:
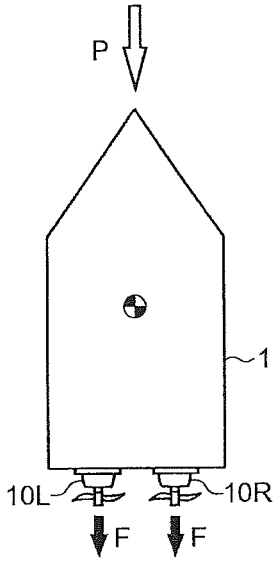
Figure 4B:
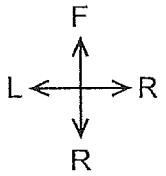

As shown in FIG. 4A, when the propulsion powers of the right outdrive device 10R and the left outdrive device 10L are in parallel to a bow direction of the hull 1, the hull 1 travels along the forward direction which is a direction of resultant of the propulsion powers. On the other hand, as shown in FIG. 4B, when the propulsion powers of the right outdrive device 10R and the left outdrive device 10L are in parallel to a stem direction of the hull 1, the hull 1 travels along the rearward direction which is a direction of resultant of the propulsion powers.

Figure 4C:
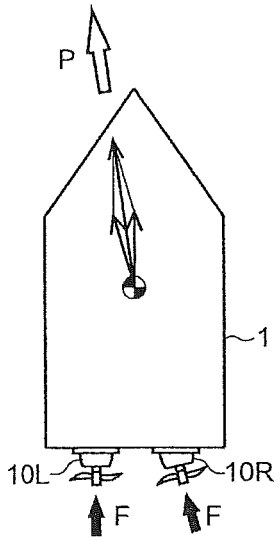
Figure 4D:
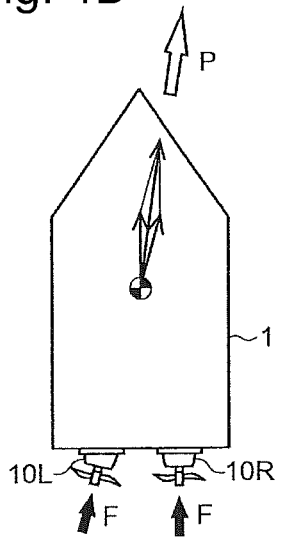

As shown in FIG. 4C, when the propulsion power of the right outdrive device 10R is tilted leftward concerning the bow direction of the hull 1 and the propulsion power of the left outdrive device 10L is in parallel to the bow direction of the hull 1, the hull 1 travels along the left oblique direction which is a direction of resultant of the propulsion powers. On the other hand, as shown in FIG. 4D, when the propulsion power of the left outdrive device 10L is tilted rightward concerning the bow direction of the hull 1 and the propulsion power of the right outdrive device 10R is in parallel to the bow direction of the hull 1, the hull 1 travels along the right oblique direction which is a direction of resultant of the propulsion powers. Such operation of the ship can suppress a steering characteristic of the hull 1 so as to realize skid movement with the fixed bow direction.

Figure 5A:
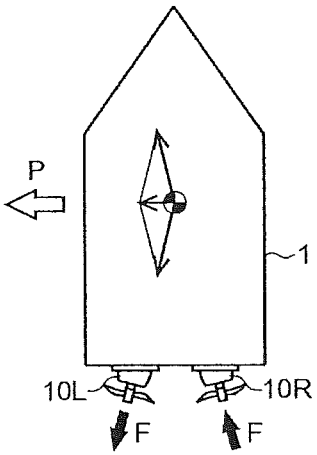
FIGS. 5A-5D are drawings of action of the hull when the steering lever is operated.
Figure 5B:
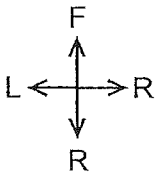
Figure 5B:
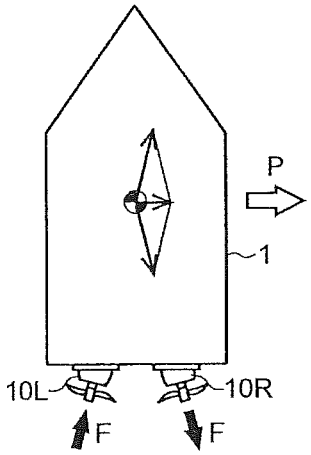

Furthermore, as shown in FIG. 5A, when the propulsion power of the right outdrive device 10R is tilted leftward concerning the bow direction of the hull 1 and the propulsion power of the left outdrive device 10L is tilted leftward concerning the stem direction of the hull 1, the hull 1 travels along the left direction which is a direction of resultant of the propulsion powers. On the other hand, as shown in FIG. 5B, when the propulsion power of the left outdrive device 10L is tilted rightward concerning the bow direction of the hull 1 and the propulsion power of the right outdrive device 10R is tilted rightward concerning the stem direction of the hull 1, the hull 1 travels along the right direction which is a direction of resultant of the propulsion powers. Such operation of the ship does not generate steering moment on the hull 1 so as to realize parallel movement with the fixed bow direction.

Figure 5C:
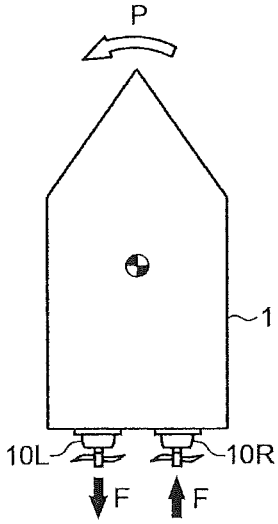
Figure 5D:
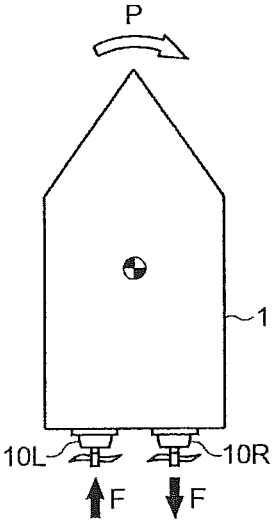

As shown in FIG. 5C, when the propulsion power of the right outdrive device 10R is in parallel to the bow direction of the hull 1 and the propulsion power of the left outdrive device 10L is in parallel to the stem direction of the hull 1, the hull 1 turns along the left direction which is a generation direction of the steering moment. On the other hand, as shown in FIG. 5D, when the propulsion power of the left outdrive device 10L is in parallel to the bow direction of the hull 1 and the propulsion power of the right outdrive device 10R is in parallel to the stem direction of the hull 1, the hull 1 turns along the right direction which is a generation direction of the steering moment. Such operation of the ship generates only the steering moment on the hull 1 so as to realize steering movement in which the bow direction is changed.

Next, calibration work is explained concretely.

In the calibration work, an actual traveling direction is adjusted to a traveling direction of the hull 1 instructed by the joystick 4. An operator can perform the calibration work following a calibration image displayed on a monitor 8. The control device 40 can display information about the calibration work on the monitor 8 (see FIGS. 1 and 2).

Figure 6A:
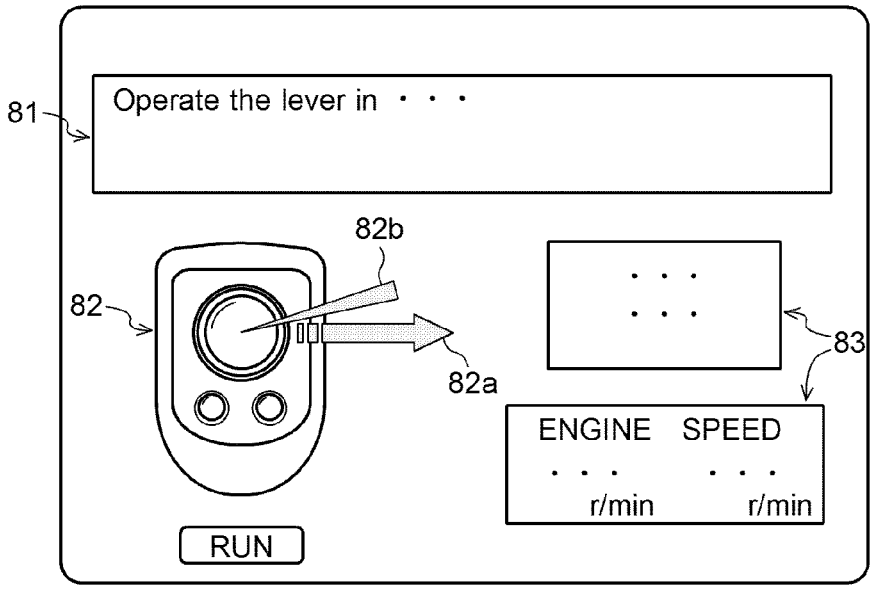
FIGS. 6A-6B are drawings of calibration images.
Figure 6B:
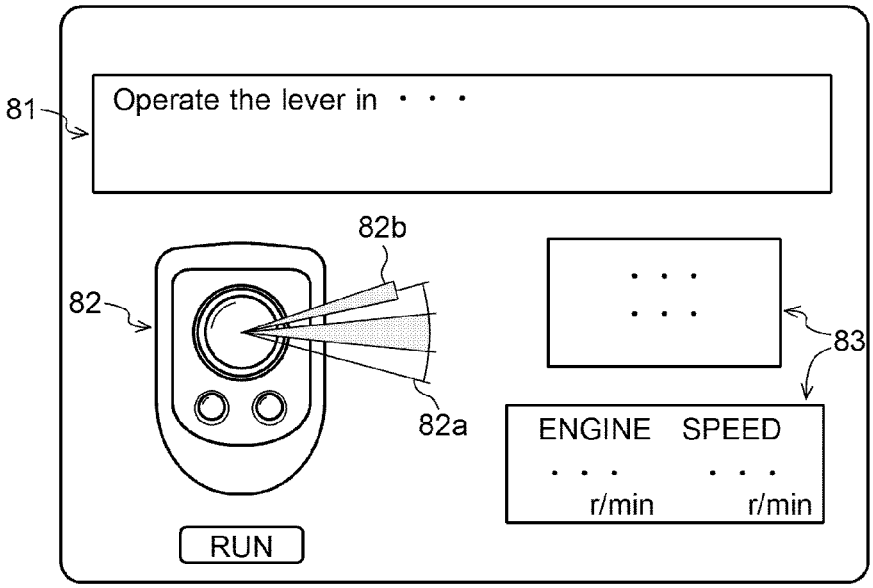

FIG. 6A-6B are drawings of calibration images. FIG. 6A shows the calibration image according to this embodiment. FIG. 6B shows the calibration image according to another embodiment.

In the calibration image, an operation guide part 81 is provided. In the operation guide part 81, an operation method of each step of the calibration work is displayed.

In the calibration image, an operation instruction part 82 of the joystick 4 is provided. In the operation instruction part 82, an icon 82*a* instructing a direction along which the joystick 4 should be moved and an icon 82*b* showing a direction along which the joystick 4 was moved are displayed. Details of the icons 82*a* and 82*b* are described later.

Furthermore, in the calibration image, another display part 83 is provided. In the display part 83, driving state (rotation speed) of the engine 5 and the like are displayed. Since the ship steering system 100 for the outdrive device has the two engines 5, the driving state (rotation speed) of each of the engines 5 is displayed.

Figure 7:
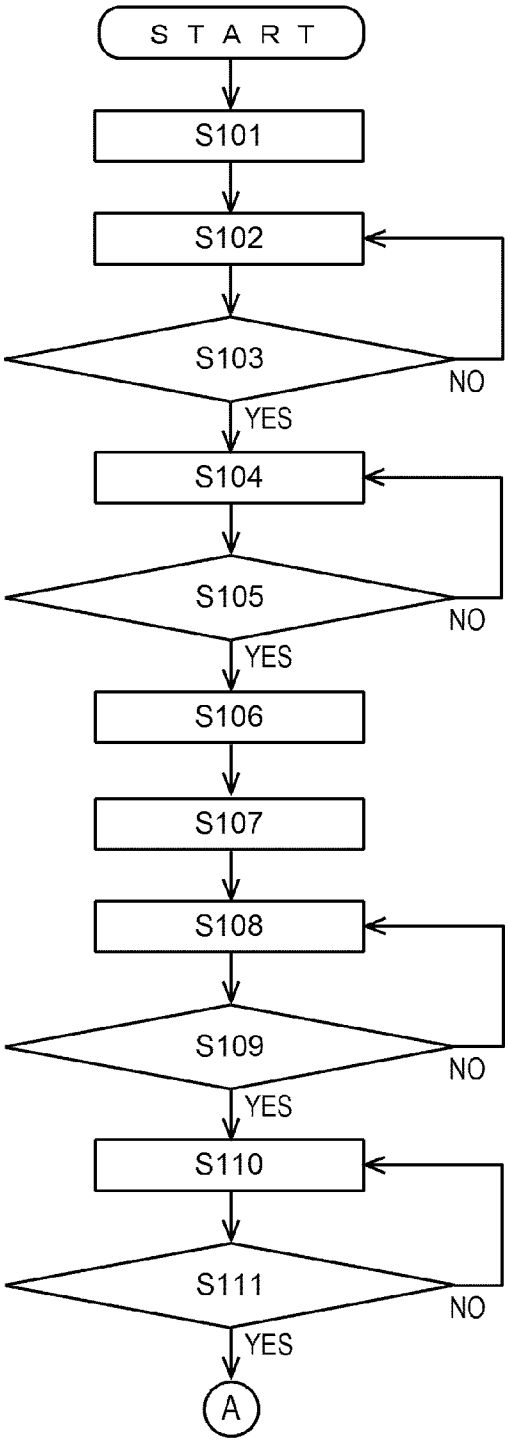
FIG. 7 is a diagram of steps of calibration work by parallel movement.
Figure 8A:
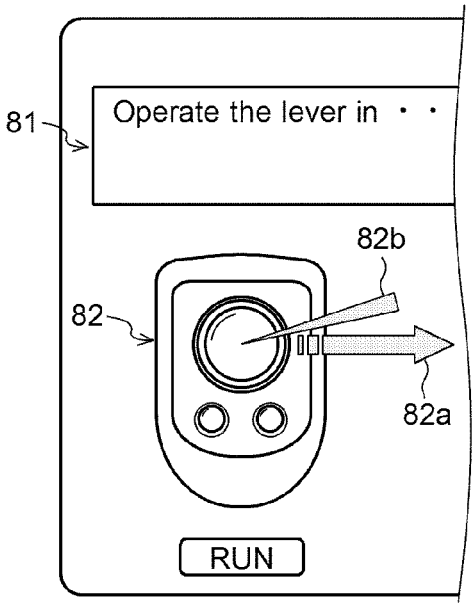
FIGS. 8A-8D are drawings of change of the calibration image.
Figure 8B:
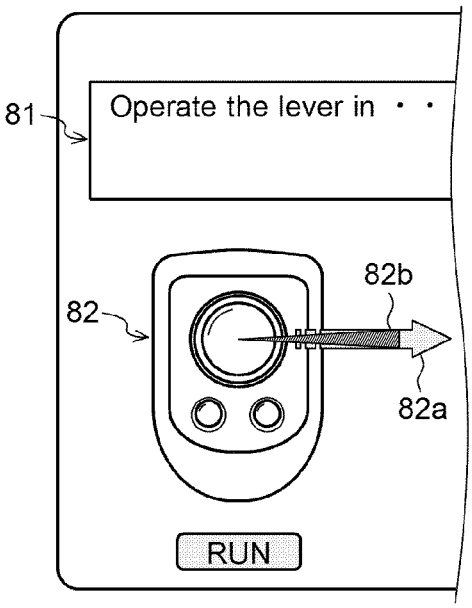
Figure 8C:
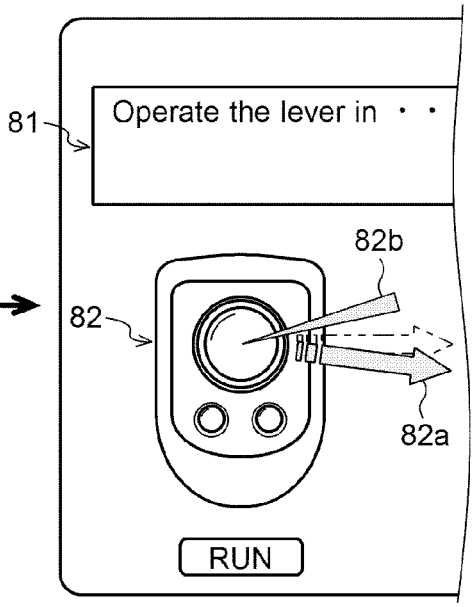
Figure 8D:
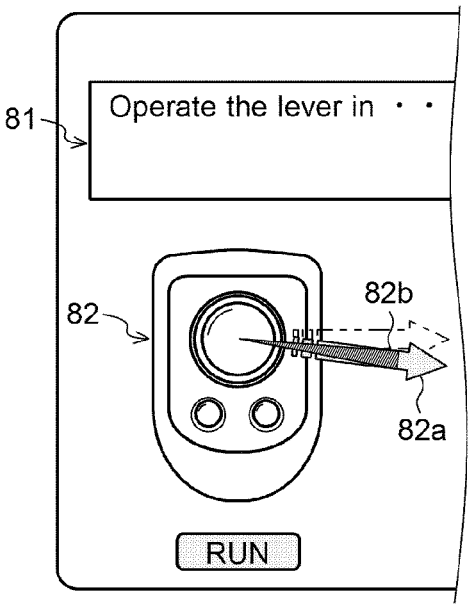

FIG. 7 is a diagram of steps of the calibration work by parallel movement. FIGS. 8A-8D are drawings of change of the calibration image.

Firstly, in a step S101, the control device 40 displays the direction along which the joystick 4 should be moved on the monitor 8. Namely, the monitor 8 shows the direction along which the joystick 4 should be moved. Since the calibration work by the parallel movement is performed in this case, the icon 82*a* is displayed so as to move the joystick 4 laterally (see FIGS. 8A and 8B). Accordingly, an operator can operate the joystick 4 without hesitation.

Next, in a step S102, the control device 40 displays the direction along which the joystick 4 was moved on the monitor 8. Namely, the monitor 8 shows the direction along which the joystick 4 was moved. It is realized by the control device 40 recognizing the direction along which the joystick 4 was moved and displaying the icon 82*b* (see FIGS. 8A and 8B). Accordingly, an operator can operate the joystick 4 while confirming the direction along which the joystick 4 was moved.

Next, in a step S103, the control device 40 judges whether the operation of the joystick 4 is proper or not. In detail, the control device 40 judges whether the direction along which the joystick 4 was moved is in agreement with the direction along which the joystick 4 should be moved shown in the step S101. The control device 40 shifts to a step S104 when the operation of the joystick 4 is judged to be proper, and returns to the step S102 when the operation of the joystick 4 is judged not to be proper.

Next, in the step S104, the control device 40 displays the purport that the operation of the joystick 4 is proper on the monitor 8. Namely, the monitor 8 shows the purport that the operation of the joystick 4 is proper. In this embodiment, it is realized by changing color of the icon 82*b* shown in the step S102 from red to green. However, it is not limited thereto and may alternatively be displayed by letters. Accordingly, an operator can recognize the purport that the operation of the joystick 4 is proper.

Next, in a step S105, the control device 40 judges whether a RUN button is pushed while the joystick 4 is operated properly or not. When the RUN button is judged to be pushed while the joystick 4 is operated properly, the control device 40 fixes a rotation angle of the outdrive device 10. Namely, the control device 40 cancels temporarily the interlocking state of the joystick 4 and the outdrive device 10. When the RUN button is judged not to be pushed while the joystick 4 is operated properly, the control device 40 returns to the step S104.

Next, in a step S106, the control device 40 calculates a collection value of the rotation angle of the outdrive device 10. In detail, the control device 40 recognizes a gap of the traveling direction of the hull 1 instructed by the joystick 4 (lateral direction) and the actual traveling direction based on information from a global positioning system (GPS), and calculates the collection value so as to cancel the gap.

Next, in a step S107, the control device 40 displays the direction along which the joystick 4 should be moved on the monitor 8. Namely, the monitor 8 shows the direction along which the joystick 4 should be moved. In this case, since the collection value of the rotation angle of the outdrive device 10 is calculated in the step S106, the icon 82*a* in consideration of the collection value is displayed (see FIGS. 8C and 8D). Accordingly, an operator can operate the joystick 4 without hesitation.

Next, in a step S108, the control device 40 displays the direction along which the joystick 4 was moved on the monitor 8. Namely, the monitor 8 shows the direction along which the joystick 4 was moved. It is realized by the control device 40 recognizing the direction along which the joystick 4 was moved and displaying the icon 82*b* (see FIGS. 8C and 8D). Accordingly, an operator can operate the joystick 4 while confirming the direction along which the joystick 4 was moved.

Next, in a step S109, the control device 40 judges whether the operation of the joystick 4 is proper or not. In detail, the control device 40 judges whether the direction along which the joystick 4 was moved is in agreement with the direction along which the joystick 4 should be moved shown in the step S107. The control device 40 shifts to a step S110 when the operation of the joystick 4 is judged to be proper, and returns to the step S108 when the operation of the joystick 4 is judged not to be proper.

Next, in the step S110, the control device 40 displays the purport that the operation of the joystick 4 is proper on the monitor 8. Namely, the monitor 8 shows the purport that the operation of the joystick 4 is proper. In this embodiment, it is realized by changing color of the icon 82*b* shown in the step S108 from red to green. However, it is not limited thereto and may alternatively be displayed by letters. Accordingly, an operator can recognize the purport that the operation of the joystick 4 is proper.

Next, in a step S111, the control device 40 judges whether the RUN button is pushed while the joystick 4 is operated properly or not. When the RUN button is judged to be pushed while the joystick 4 is operated properly, the control device 40 performs the calibration. Namely, when the joystick 4 is moved laterally, the control device 40 set the rotation angle of the outdrive device 10 to be the value in the step S110.

As the above, the monitor 8 shows the direction along which the joystick 4 should be moved (see the steps S101 and S107), and shows when the joystick 4 is moved along the shown direction, the monitor 8 shows the purport that the operation of the joystick 4 is proper (see the steps S104 and S110). Accordingly, an operator can operate the joystick 4 without hesitation and recognize the purport that the operation is proper. Therefore, the calibration work can be performed easily.

Furthermore, in detail, when the gap exists between the traveling direction of the hull 1 instructed by the joystick 4 and the actual traveling direction, the monitor 8 shows the direction along which the joystick 4 should be moved which is collected so as to cancel the gap (see the step S107). Accordingly, an operator can make the traveling direction of the hull 1 instructed by the joystick 4 in agreement with the actual traveling direction accurately. Therefore, the calibration work can be performed easily.

The above is the calibration work by the parallel movement. After the calibration work by the parallel movement, the ship steering system 100 for the outdrive device performs the calibration work by the skid movement.

Figure 9:
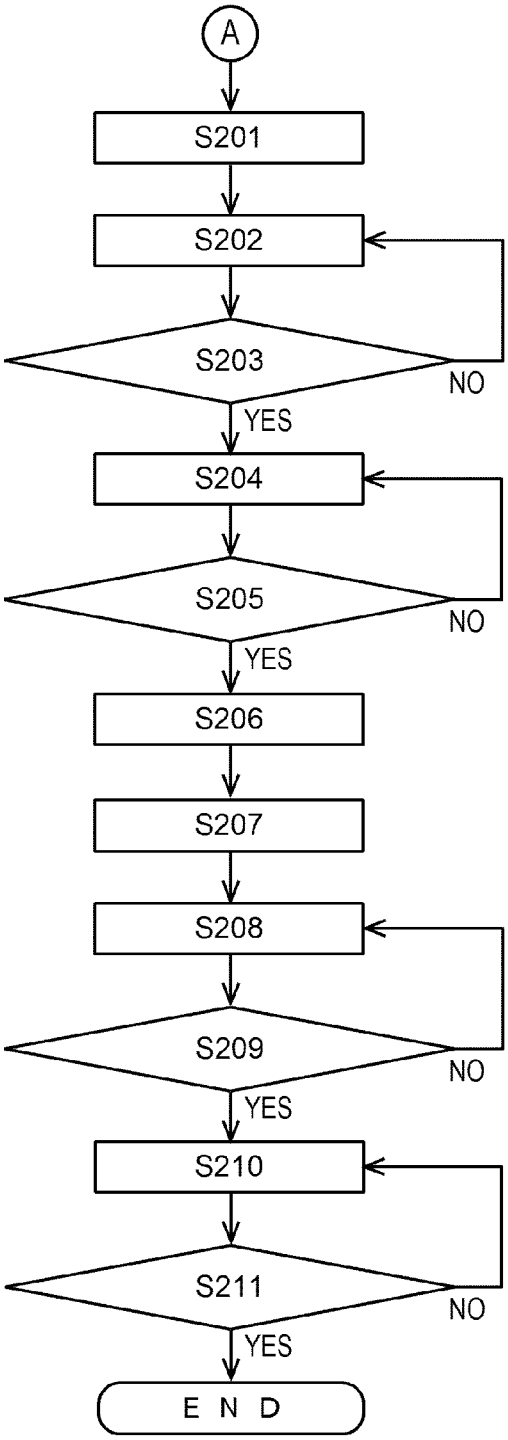
FIG. 9 is a diagram of steps of calibration work by skid movement.
Figure 10A:
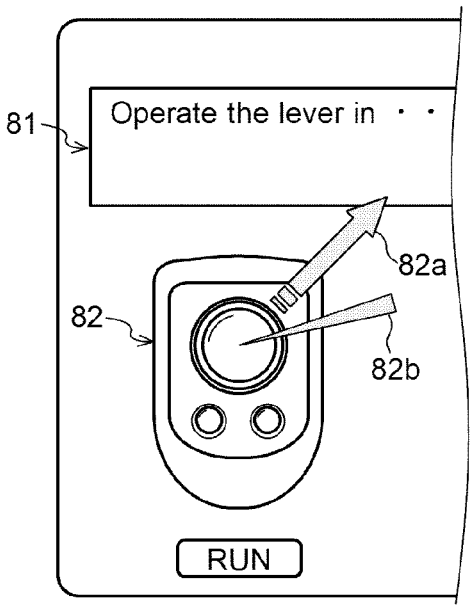
FIGS. 10A-10D are drawings of change of the calibration image.
Figure 10B:
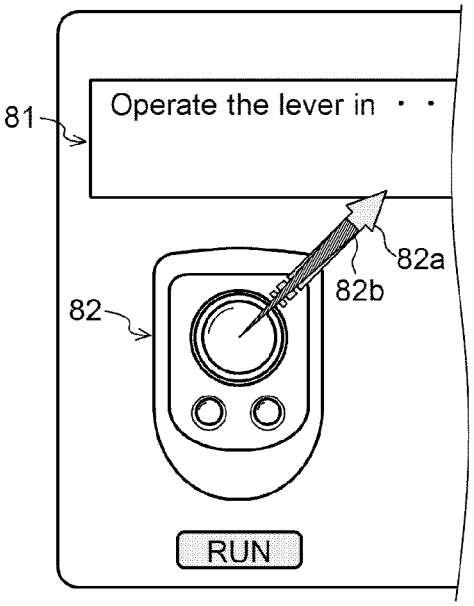
Figure 10C:
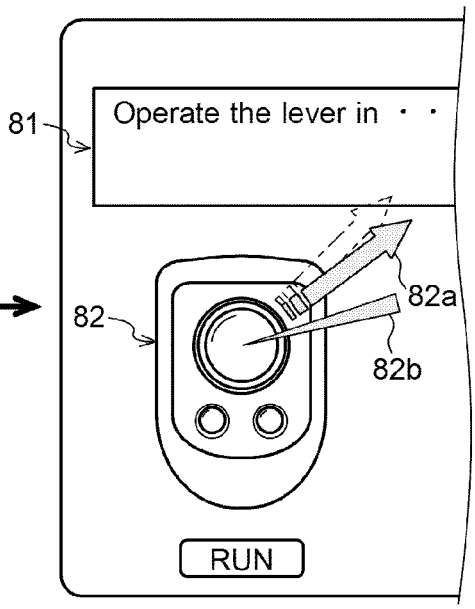
Figure 10D:
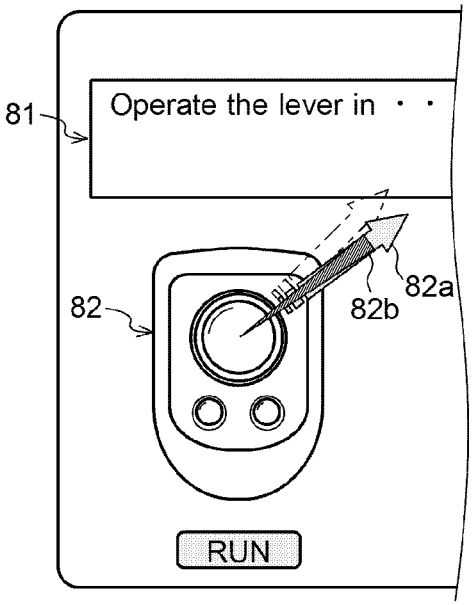

FIG. 9 is a diagram of steps of the calibration work by the skid movement. FIGS. 10A-10D are drawings of change of the calibration image.

Firstly, in a step S201, the control device 40 displays the direction along which the joystick 4 should be moved on the monitor 8. Namely, the monitor 8 shows the direction along which the joystick 4 should be moved. Since the calibration work by the skid movement is performed in this case, the icon 82*a* is displayed so as to move the joystick 4 aslant (see FIGS. 10A and 10B). Accordingly, an operator can operate the joystick 4 without hesitation.

Next, in a step S202, the control device 40 displays the direction along which the joystick 4 was moved on the monitor 8. Namely, the monitor 8 shows the direction along which the joystick 4 was moved. It is realized by the control device 40 recognizing the direction along which the joystick 4 was moved and displaying the icon 82*b* (see FIGS. 10A and 10B). Accordingly, an operator can operate the joystick 4 while confirming the direction along which the joystick 4 was moved.

Next, in a step S203, the control device 40 judges whether the operation of the joystick 4 is proper or not. In detail, the control device 40 judges whether the direction along which the joystick 4 was moved is in agreement with the direction along which the joystick 4 should be moved shown in the step S201. The control device 40 shifts to a step S204 when the operation of the joystick 4 is judged to be proper, and returns to the step S202 when the operation of the joystick 4 is judged not to be proper.

Next, in the step S204, the control device 40 displays the purport that the operation of the joystick 4 is proper on the monitor 8. Namely, the monitor 8 shows the purport that the operation of the joystick 4 is proper. In this embodiment, it is realized by changing color of the icon 82*b* shown in the step S202 from red to green. However, it is not limited thereto and may alternatively be displayed by letters. Accordingly, an operator can recognize the purport that the operation of the joystick 4 is proper.

Next, in a step S205, the control device 40 judges whether the RUN button is pushed while the joystick 4 is operated properly or not. When the RUN button is judged to be pushed while the joystick 4 is operated properly, the control device 40 fixes a rotation angle of the outdrive device 10. Namely, the control device 40 cancels temporarily the interlocking state of the joystick 4 and the outdrive device 10. When the RUN button is judged not to be pushed while the joystick 4 is operated properly, the control device 40 returns to the step S204.

Next, in a step S206, the control device 40 calculates a collection value of the rotation angle of the outdrive device 10. In detail, the control device 40 recognizes a gap of the traveling direction of the hull 1 instructed by the joystick 4 (slanting direction) and the actual traveling direction based on information from the global positioning system (GPS), and calculates the collection value so as to cancel the gap.

Next, in a step S207, the control device 40 displays the direction along which the joystick 4 should be moved on the monitor 8. Namely, the monitor 8 shows the direction along which the joystick 4 should be moved. In this case, since the collection value of the rotation angle of the outdrive device 10 is calculated in the step S206, the icon 82*a* in consideration of the collection value is displayed (see FIGS. 10C and 10D). Accordingly, an operator can operate the joystick 4 without hesitation.

Next, in a step S208, the control device 40 displays the direction along which the joystick 4 was moved on the monitor 8. Namely, the monitor 8 shows the direction along which the joystick 4 was moved. It is realized by the control device 40 recognizing the direction along which the joystick 4 was moved and displaying the icon 82*b* (see FIGS. 10C and 10D). Accordingly, an operator can operate the joystick 4 while confirming the direction along which the joystick 4 was moved.

Next, in a step S209, the control device 40 judges whether the operation of the joystick 4 is proper or not. In detail, the control device 40 judges whether the direction along which the joystick 4 was moved is in agreement with the direction along which the joystick 4 should be moved shown in the step S207. The control device 40 shifts to a step S210 when the operation of the joystick 4 is judged to be proper, and returns to the step S208 when the operation of the joystick 4 is judged not to be proper.

Next, in the step S210, the control device 40 displays the purport that the operation of the joystick 4 is proper on the monitor 8. Namely, the monitor 8 shows the purport that the operation of the joystick 4 is proper. In this embodiment, it is realized by changing color of the icon 82*b* shown in the step S208 from red to green. However, it is not limited thereto and may alternatively be displayed by letters. Accordingly, an operator can recognize the purport that the operation of the joystick 4 is proper.

Next, in a step S211, the control device 40 judges whether the RUN button is pushed while the joystick 4 is operated properly or not. When the RUN button is judged to be pushed while the joystick 4 is operated properly, the control device 40 performs the calibration. Namely, when the joystick 4 is moved aslant, the control device 40 set the rotation angle of the outdrive device 10 to be the value in the step S210.

As the above, the monitor 8 shows the direction along which the joystick 4 should be moved (see the steps S201 and S207), and shows when the joystick 4 is moved along the shown direction, the monitor 8 shows the purport that the operation of the joystick 4 is proper (see the steps S204 and S210). Accordingly, an operator can operate the joystick 4 without hesitation and recognize the purport that the operation is proper. Therefore, the calibration work can be performed easily.

Furthermore, in detail, when the gap exists between the traveling direction of the hull 1 instructed by the joystick 4 and the actual traveling direction, the monitor 8 shows the direction along which the joystick 4 should be moved which is collected so as to cancel the gap (see the step S207). Accordingly, an operator can make the traveling direction of the hull 1 instructed by the joystick 4 in agreement with the actual traveling direction accurately. Therefore, the calibration work can be performed easily.

When the ship steering system 100 for the outdrive device is not interlocked with the global positioning system, an operator may operate the joystick 4 so as to collect the rotation angle of the outdrive device 10. When the ship steering system 100 is not interlocked with the global positioning system, the collection value explained in the step S106 or S206 cannot be calculated. Therefore, the icon 82*a* in consideration of the collection value explained in the step S107 or S207 cannot be displayed. Accordingly, when an operator operates the joystick 4 so as to collect the rotation angle of the outdrive device 10 and pushes the RUN button, the control device 40 performs the calibration.

In this case, the monitor 8 shows the direction along which the joystick 4 was moved, and when the direction along which the joystick 4 was moved is in agreement with the direction set preferably, shows the purport that the operation is proper. Accordingly, an operator can perform the operation while confirming the direction along which the joystick 4 was moved and can confirm the purport that the operation is proper. Therefore, the calibration work can be performed easily.

Next, calibration work according to another embodiment is explained.

Figure 11:
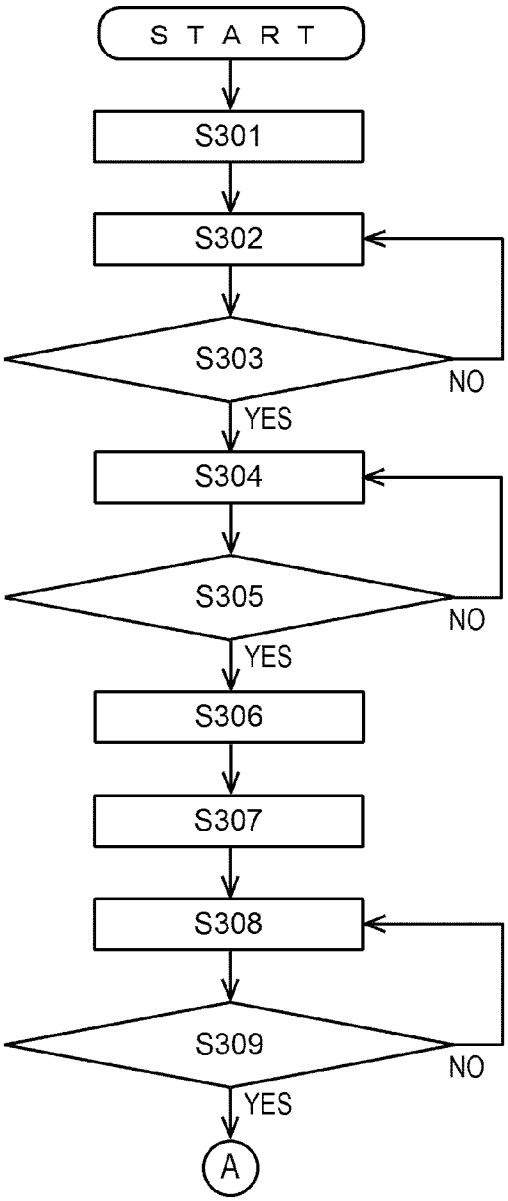
FIG. 11 is a diagram of steps of calibration work by parallel movement.
Figure 12A:
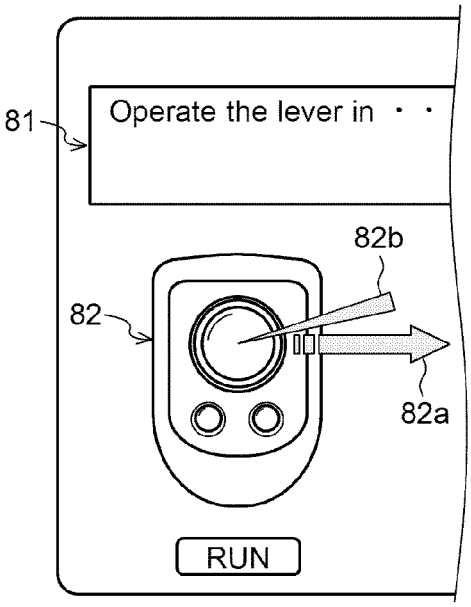
FIGS. 12A-12D are drawings of change of the calibration image.
Figure 12C:
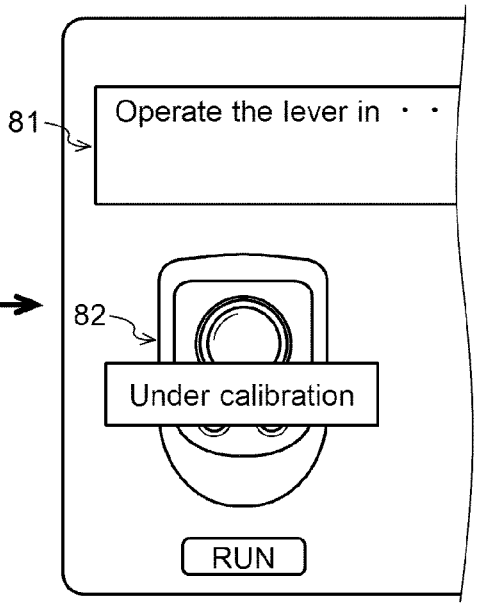
Figure 12B:
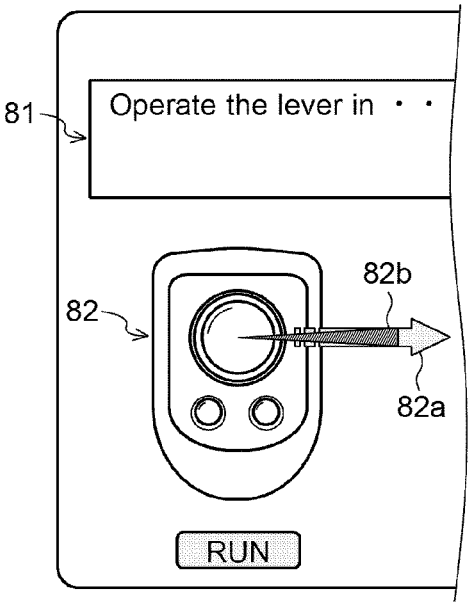
Figure 12D:
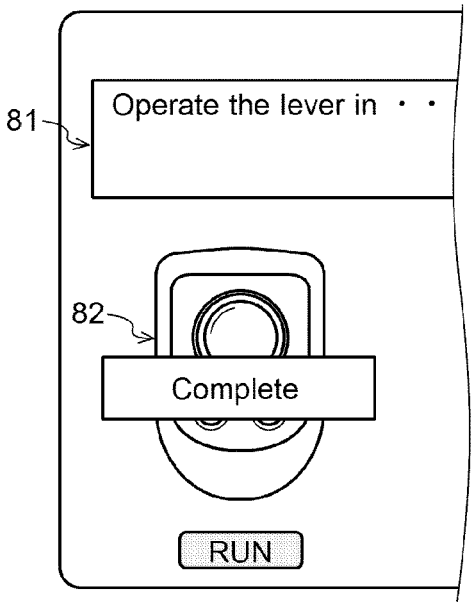

FIG. 11 is a diagram of steps of the calibration work by the parallel movement. FIGS. 12A-12D are drawings of change of the calibration image.

Steps S301 to S306 are similar to the above calibration work. Accordingly, explanations of these steps are omitted.

In a step S307, the control device 40 collects the rotation angle of the outdrive device 10. In detail, the control device 40 collects the rotation angle of the outdrive device 10 so as to cancel the gap of the traveling direction of the hull 1 instructed by the joystick 4 (lateral direction) and the actual traveling direction. In this case, since the collection value of the rotation angle of the outdrive device 10 is calculated in the step S306, the rotation direction of the outdrive device 10 is collected based on the collection value. At this time, the purport that the collection is being performed is displayed in the calibration image (see FIG. 12C).

Next, in a step S308, the control device 40 displays the purport that the collection is finished on the monitor 8. Namely, the monitor 8 shows the purport that the collection is finished (see FIG. 12D). Accordingly, an operator can recognize the purport that the collection of the rotation direction of the outdrive device 10 is finished.

Next, in a step S309, the control device 40 judges whether the RUN button is pushed or not. When the RUN button is judged to be pushed, the control device 40 performs the calibration. Namely, when the joystick 4 is moved laterally, the control device 40 set the rotation angle of the outdrive device 10 to be the value in the step S308.

As the above, when the gap exists between the traveling direction of the hull 1 instructed by the joystick 4 and the actual traveling direction, the monitor 8 collects the rotation direction of the outdrive device 10 so as to cancel the gap (see the step S307) and shows the purport that the collection is finished (see the step S308). Accordingly, an operator can make the traveling direction of the hull 1 instructed by the joystick 4 in agreement with the actual traveling direction accurately. Therefore, the calibration work can be performed easily.

The above is the calibration work by the parallel movement. As mentioned above, after the calibration work by the parallel movement, the ship steering system 100 for the outdrive device performs the calibration work by the skid movement.

Figure 13:
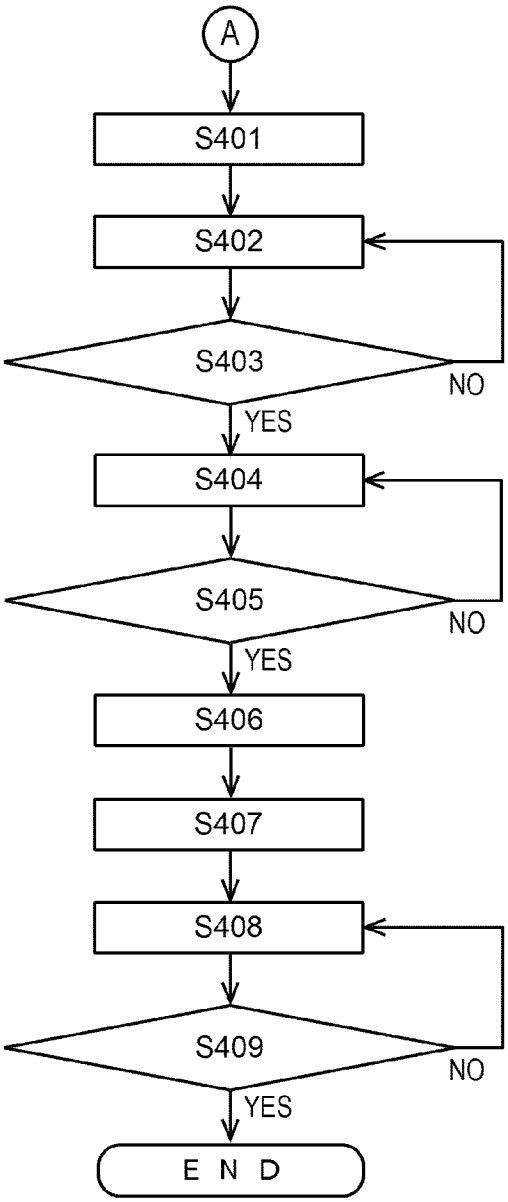
FIG. 13 is a diagram of steps of calibration work by skid movement.
Figure 14A:
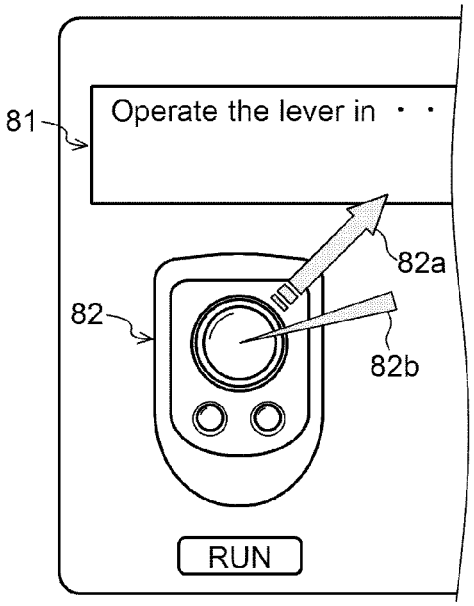
FIGS. 14A-14D are drawings of change of the calibration image.
Figure 14B:
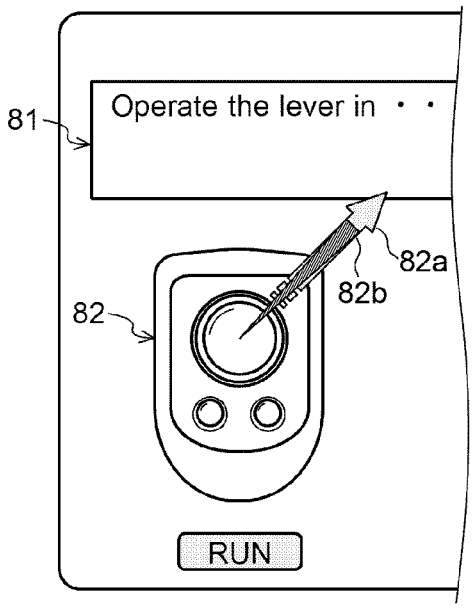
Figure 14C:
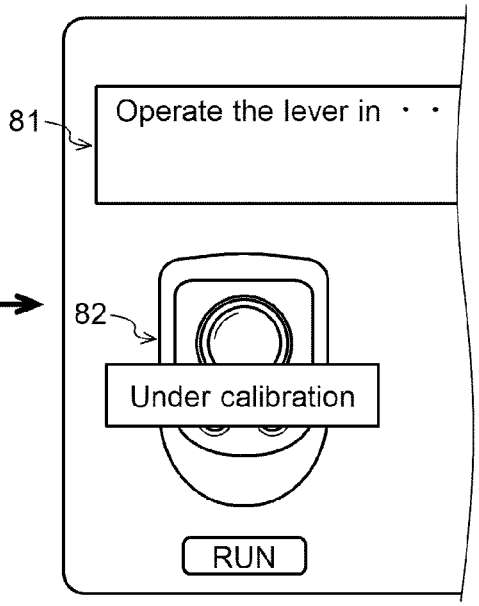
Figure 14D:
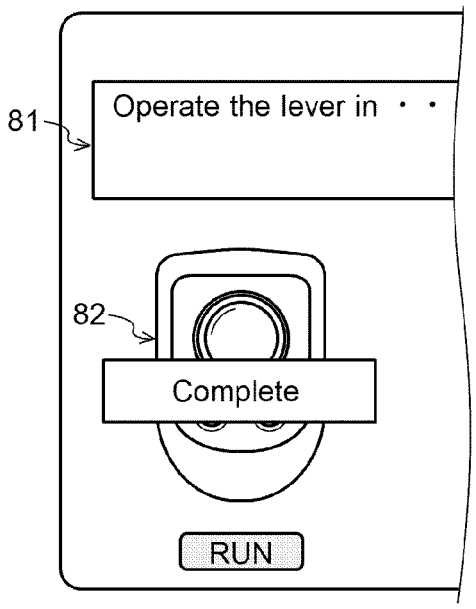

FIG. 13 is a diagram of steps of the calibration work by the skid movement. FIGS. 14A-14D are drawings of change of the calibration image.

Steps S401 to S406 are similar to the above calibration work. Accordingly, explanations of these steps are omitted.

In a step S407, the control device 40 collects the rotation angle of the outdrive device 10. In detail, the control device 40 collects the rotation angle of the outdrive device 10 so as to cancel the gap of the traveling direction of the hull 1 instructed by the joystick 4 (slanting direction) and the actual traveling direction. In this case, since the collection value of the rotation angle of the outdrive device 10 is calculated in the step S406, the rotation direction of the outdrive device 10 is collected based on the collection value. At this time, the purport that the collection is being performed is displayed in the calibration image (see FIG. 14C).

Next, in a step S408, the control device 40 displays the purport that the collection is finished on the monitor 8. Namely, the monitor 8 shows the purport that the collection is finished (see FIG. 14D). Accordingly, an operator can recognize the purport that the collection of the rotation direction of the outdrive device 10 is finished.

Next, in a step S409, the control device 40 judges whether the RUN button is pushed or not. When the RUN button is judged to be pushed, the control device 40 performs the calibration. Namely, when the joystick 4 is moved aslant, the control device 40 set the rotation angle of the outdrive device 10 to be the value in the step S408.

As the above, when the gap exists between the traveling direction of the hull instructed by the joystick 4 and the actual traveling direction, the monitor 8 collects the rotation direction of the outdrive device 10 so as to cancel the gap (see the step S407) and shows the purport that the collection is finished (see the step S408). Accordingly, an operator can make the traveling direction of the hull 1 instructed by the joystick 4 in agreement with the actual traveling direction accurately. Therefore, the calibration work can be performed easily.

It is a prerequisite that the calibration work according to this embodiment is interlocked with the global positioning system. When not interlocked with the global positioning system, the collection value explained in the step S306 or S406 cannot be calculated. Accordingly, the rotation angle of the outdrive device 10 cannot be collected as explained in the step S307 or S407.

Next, the icon 82*a* is explained.

As shown in FIG. 6A, the icon 82*a* is shown with an arrow-like shape and shows the direction along which the joystick 4 should be moved. The icon 82*a* can express clearly the direction along which the joystick 4 should be moved. However, when the direction shown by the icon 82*a* is not in agreement completely with the direction along which the joystick 4 was moved, the operation is not judged to be proper. Accordingly, an operator must operate the joystick 4 carefully.

In that respect, the icon 82*a* shown in FIG. 6B makes the operation of the joystick 4 easy. Namely, the icon 82*a* shows the direction along which the joystick 4 should be moved by a range of predetermined angle centering on a fulcrum of the joystick 4, whereby an operator just has to move the joystick 4 to the range shown by the icon 82*a*. Then, the purport that the operation is proper should be shown when the joystick is moved to the shown range.

As the above, the monitor 8 shows the direction along which the joystick 4 should be moved by the range of the predetermined angle centering on the fulcrum of the joystick 4, and shows the purport that the operation is proper when the joystick is moved to the shown range. Accordingly, an operator can operate the joystick 4 without being too careful and can recognize the purport that the operation is proper. Therefore, the calibration work can be performed easily.

Next, the other features of the ship steering system 100 for the outdrive device are explained.

As the above, in the calibration work, the calibration work by the skid movement is performed after the calibration work by the parallel movement. This is the matter naturally known in the case of performing the calibration work. However, when an operation is unfamiliar to the calibration work, the order may be mistaken. Accordingly, the monitor 8 displays the image for the calibration by the parallel movement, and subsequently displays the image for the calibration by the skid movement.

As the above, the monitor 8 displays the image for the calibration by the parallel movement, and subsequently displays the image for the calibration by the skid movement. Accordingly, an operator can perform correctly the calibration work without mistaking the order. Therefore, the calibration work can be performed easily.

By the way, for attaching the conventional outdrive device to the hull in the suitable state, proofreading of the outdrive device such as propriety of piping and wiring of a hydraulic cylinder, a proportional electromagnetic valve switching a flow direction of pressure oil and a piston position detection device, setting of a stroke end of the hydraulic cylinder, and the like should be executed. However, in the proofreading of the outdrive device, steps of work are complicated and confirmation by viewing may be difficult because of structures such as the engine arranged around the outdrive device. Accordingly, in the proofreading of the outdrive device, there is a problem in that proofreading results without a skilled operator may not be uniform.

For operating appropriately the ship by the conventional outdrive device, the proofreading of the outdrive device such as propriety of piping and wiring of the hydraulic cylinder, the proportional electromagnetic valve switching the flow direction of pressure oil and the piston position detection device, setting of the stroke end of the hydraulic cylinder, and the like should be executed. Namely, the ship cannot be operated correctly by the outdrive device in which the proofreading is not finished. However, there is a problem in that there is no means for confirming objectively whether the proofreading of the outdrive device attached to the ship is finished or not and the operation of the ship in which the proofreading of the outdrive device is not finished appropriately cannot be prevented certainly.

Then, the ship having an automatic proofreading function which can execute the proofreading of the outdrive device certainly while suppressing variation and can prevent the operation of the outdrive device before the proofreading so as to suppress incorrect operation of the outdrive device is disclosed.

Firstly, a whole outline and a configuration of a ship 50 having the outdrive device 10 is explained referring to FIGS. 1 to 19. The ship 50 in FIGS. 1 and 2 is a so-called biaxial propulsion ship which has the two outdrive devices 10. However, the ship is not limited thereto and may alternatively be a monoaxial propulsion ship.

As shown in FIGS. 1 and 2, in the ship 50, driving state of an engine 5 is controlled corresponding to operation of the throttle lever 2, and as a result, rotation speed of the screw propeller 15 can be changed. In the ship 50, the hull 1 has the outdrive devices 10, the steering hydraulic actuator 20, the electromagnetic proportional valve 30 and the control device 40. In the ship 50, the hull 1 has the steering wheel 3 and the joystick 4 for controlling the outdrive devices 10. Furthermore, in the hull 1, the monitor 8 displaying operation state of the steering wheel 3 and the joystick 4 is arranged near them. The ship 50 is configured so that the outdrive devices 10 can be rotated corresponding to operation of the steering wheel 3 and the joystick 4.

As shown in FIG. 3, the outdrive devices 10 propel the hull 1 by rotating the screw propellers 15. The outdrive devices 10 rotate itself concerning the traveling direction of the hull 1 so as to turn the hull 1. As shown in FIG. 3, each of the outdrive devices 10 includes mainly the input shaft 11, the switching clutch 12, the drive shaft 13, the output shaft 14 and the screw propeller 15.

The input shaft 11 transmits rotation power of the engine 5 to the switching clutch 12. One of ends of the input shaft 11 is connected to a universal joint attached to the output shaft of the engine 5, and the other end thereof is connected to the switching clutch 12 arranged inside the upper housing 10U.

The switching clutch 12 can switch the rotation power of the engine 5, transmitted via the input shaft 11 and the like, to forward or reverse direction. The switching clutch 12 has a forward bevel gear and a reverse bevel gear which are connected to an inner drum having disc plates, and the rotation direction is changed according to whether one of the disc plates is pressed by a pressure plate of an outer drum connected to the input shaft 11.

The drive shaft 13 transmits the rotation power of the engine 5, transmitted via the switching clutch 12 and the like, to the output shaft 14. A bevel gear provided at one of ends of the drive shaft 13 is meshed with the forward bevel gear and the reverse bevel gear provided in the switching clutch 12, and a bevel gear provided at the other end is meshed with a bevel gear provided on the output shaft 14 arranged inside the lower housing 10R.

The output shaft 14 transmits the rotation power of the engine 5, transmitted via the drive shaft 13 and the like, to the screw propeller 15. As mentioned above, the bevel gear provided at one of ends of the output shaft 14 is meshed with the bevel gear of the drive shaft 13, and the other end is attached thereto with the screw propeller 15.

The screw propeller 15 is rotated so as to generate propulsion power. The screw propeller 15 is driven by the rotation power of the engine 5 transmitted via the output shaft 14 and the like so that a plurality of blades 15*a* arranged around a rotation shaft paddle surrounding water, whereby the propulsion power is generated.

The outdrive device 10 is supported by the gimbal housing 7 attached to the stern board (transom board) of the hull 1. Concretely, the outdrive device 10 is supported by the gimbal housing 7 so as to make the gimbal ring 16 of the outdrive device 10 substantially perpendicular to the waterline w1. The gimbal ring 16 is a substantially cylindrical rotation shaft attached to the outdrive device 10, and the outdrive device 10 is rotated centering on the gimbal ring 16.

The steering arm 17 extended into the hull 1 is attached to an upper end of the gimbal ring 16. The steering arm 17 rotates the outdrive device 10 centering on the gimbal ring 16. The steering arm 17 is driven by the steering hydraulic actuator 20 interlocked with operation of the steering wheel 3 and the joystick 4.

Figure 15:
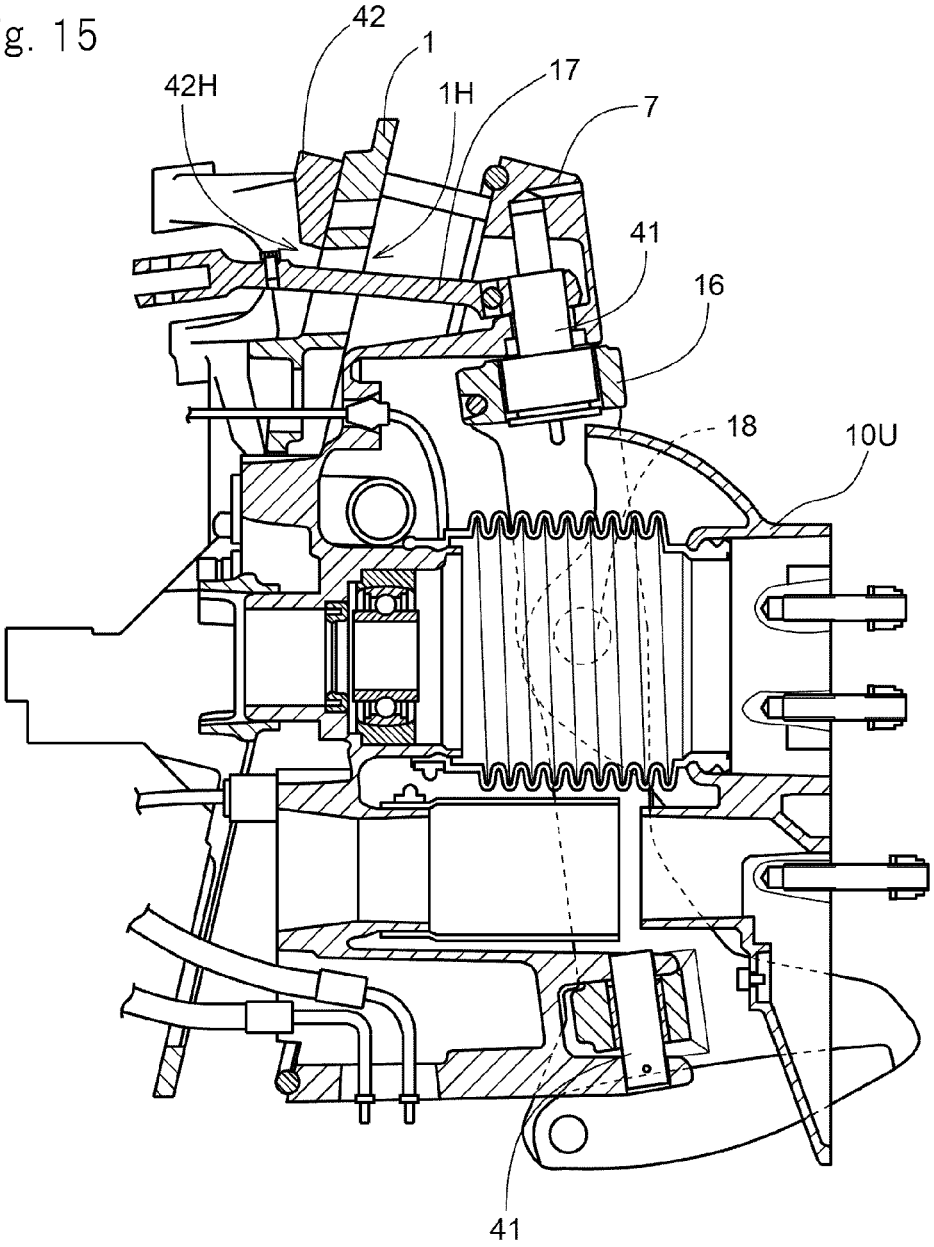
FIG. 15 is a drawing of attachment structure of the outdrive device.
Figure 16:
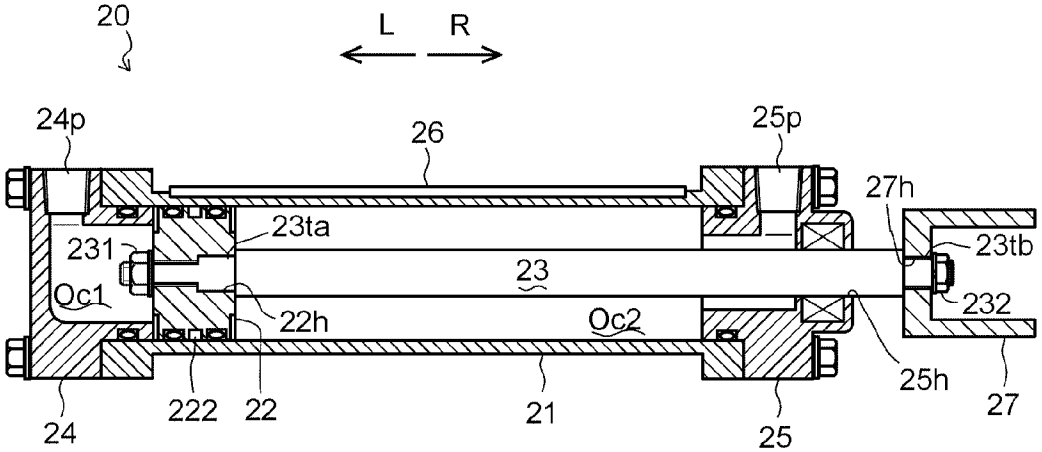
FIG. 16 is a drawing of a configuration of a steering hydraulic actuator.
Figure 17:
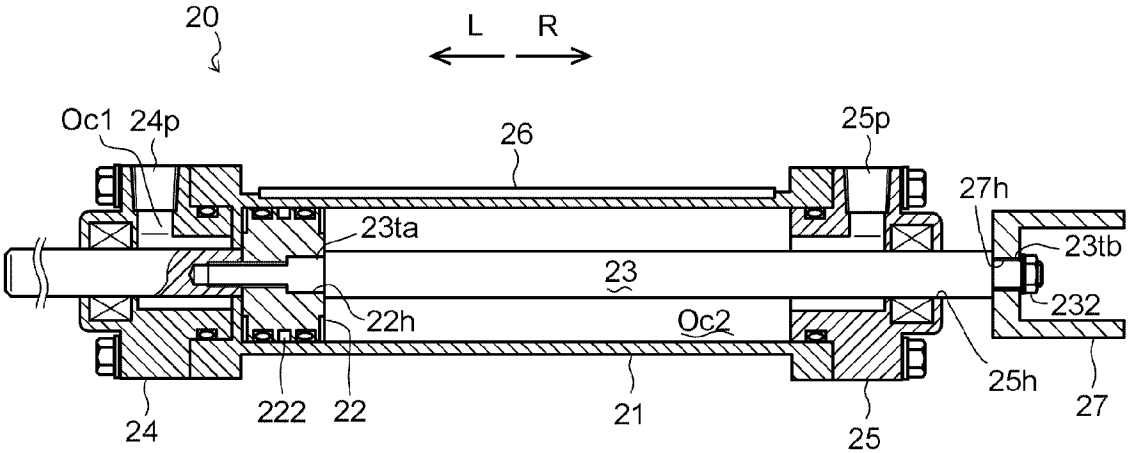
FIG. 17 is another drawing of the configuration of the steering hydraulic actuator.

An attachment structure of the outdrive device 10 is explained in detail referring to FIGS. 15 to 17.

A bracket 42 is attached to a front surface side of the stern board (transom board). The gimbal housing 7 is attached to a rear surface side of the stern board (transom board). Two rotation shafts 41 are provided substantially vertically in the gimbal housing 7, and the gimbal ring 16 is supported rotatably by the rotation shafts 41. In a middle part of the gimbal ring 16, two rotation shafts 18 are provided horizontally, and an upper front part of the upper housing 10U is supported rotatably by the rotation shafts 18.

The steering arm 17 is attached to an upper end of corresponding one of the rotation shafts 41. The steering arm 17 is extended into the hull 1 via through holes 1H and 42H provided in the hull 1 and the bracket 42. An end of the steering arm 17 is connected to the steering hydraulic actuator 20 (see FIG. 3). Accordingly, by operating the steering hydraulic actuator 20, the outdrive device 10 is rotated laterally centering on the gimbal ring 16.

A lifting hydraulic actuator 9 is interposed between a lower part of the gimbal ring 16 and the upper housing 10U (see FIG. 3). Accordingly, by operating the lifting hydraulic actuator 9, the outdrive device 10 is rotated vertically centering on the rotation shafts 18.

The steering hydraulic actuator 20 drives the steering arm 17 of the outdrive device 10 so as to rotate the outdrive device 10. As shown in FIG. 16, the steering hydraulic actuator 20 includes mainly a cylinder sleeve 21, a piston 22, a rod 23, a first cylinder cap 24, a second cylinder cap 25 and a position sensor 26. The steering hydraulic actuator 20 according to this embodiment is so-called single rod type hydraulic actuator. However, the steering hydraulic actuator 20 may alternatively be double rod type shown in FIG. 17.

The cylinder sleeve 21 is provided slidably therein with the piston 22. In each of end parts of the cylinder sleeve 21, a flange part projecting in a peripheral direction is provided. The first cylinder cap 24 or the second cylinder cap 25 is fixed to the flange part.

The piston 22 is slid in the cylinder sleeve 21 by receiving hydraulic pressure. In the piston 22, a through hole 22*h* is provided coaxially to an axis of the piston 22, and the rod 23 is inserted into the through hole 22*h*. Ring grooves are provided in an outer peripheral surface of the piston 22 along a peripheral direction thereof, and a seal ring is attached circularly to each of the ring grooves. A permanent magnet 222 is attached to the outer peripheral surface of the piston 22 between the seal rings.

The rod 23 transmits the sliding of the piston 22 to the steering arm 17. At one of ends of the rod 23, a reduced diameter part 23*ta* at which an outer diameter of the rod 23 is reduced is provided. A nut 231 is screwed to the rod 23 while the reduced diameter part 23*ta* is inserted into the through hole 22*h* of the piston 22, whereby the rod 23 is fixed to the piston 22. At the other end of the rod 23, a reduced diameter part 23*tb* at which the outer diameter of the rod 23 is reduced is provided. A nut 232 is screwed to the rod 23 while the reduced diameter part 23*tb* is inserted into a through hole 27*h* of a clevis 27, whereby the rod 23 is fixed to the clevis 27. The clevis 27 is a connection member connecting the rod 23 to the steering arm 17.

The first cylinder cap 24 seals one of ends of the cylinder sleeve 21. In the first cylinder cap 24, a first oil passage 24*p* communicated with a first oil chamber Oc1 configured by the cylinder sleeve 21 and the piston 22 is provided. A ring groove is provided in a peripheral wall surface, which is inserted into the cylinder sleeve 21, along a peripheral direction thereof, and a seal ring is attached circularly to the ring groove. Accordingly, the first oil chamber Oc1 configures a pressure-resistant chamber which can resist predetermined hydraulic pressure.

The second cylinder cap 25 seals the other end of the cylinder sleeve 21 and supports slidably the rod 23. In the second cylinder cap 25, a second oil passage 25*p* communicated with a second oil chamber Oc2 configured by the cylinder sleeve 21 and the piston 22 is provided. A ring groove is provided in a peripheral wall surface, which is inserted into the cylinder sleeve 21, along a peripheral direction thereof, and a seal ring is attached circularly to the ring groove. Furthermore, in the second cylinder cap 25, a through hole 25*h* is provided coaxially to an axis of the cylinder sleeve 21, and the rod 23 is inserted into the through hole 25*h*. A ring groove is provided in an inner peripheral surface of the through hole 25*h* along a peripheral direction thereof, and a seal ring is attached circularly to the ring groove. Accordingly, the second oil chamber Oc2 configures a pressure-resistant chamber which can resist predetermined hydraulic pressure.

The position sensor 26 detects magnetic force of the permanent magnet 222 attached to the piston 22. The position sensor 26 is attached to an outer peripheral surface of the cylinder sleeve 21 so as to be in parallel to a sliding direction of the piston 22 at least within a slidable range of the piston 22. Accordingly, the control device 40 can grasp a position of the piston 22, as a result can grasp a steering angle of the outdrive device 10. The control device 40 can recognize the sliding direction of the piston 22 by grasping the position of the piston 22 for every unit time.

The position sensor 26 is configured by a so-called hall element which exchanges output voltage mainly corresponding to change of magnetic flux density. The hall element detects strength of a magnetic field from potential difference caused by Lorentz force (hall voltage) by using a fact that the Lorentz force acts on electrons by interaction of the magnetic field and current. In this embodiment, the hall element is used as a main component of the position sensor 26. However, the configuration is not limited thereto and a magnetoresistive element whose electric resistance value is changed corresponding to the strength of the magnetic field may alternatively be used.

Figure 18:
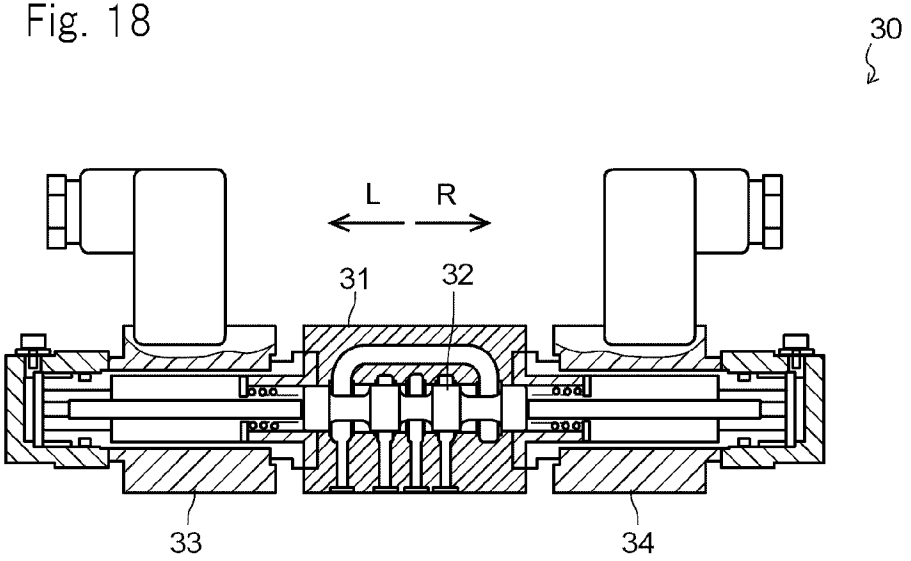
FIG. 18 is a drawing of a configuration of a proportional electromagnetic valve.
Figure 19:
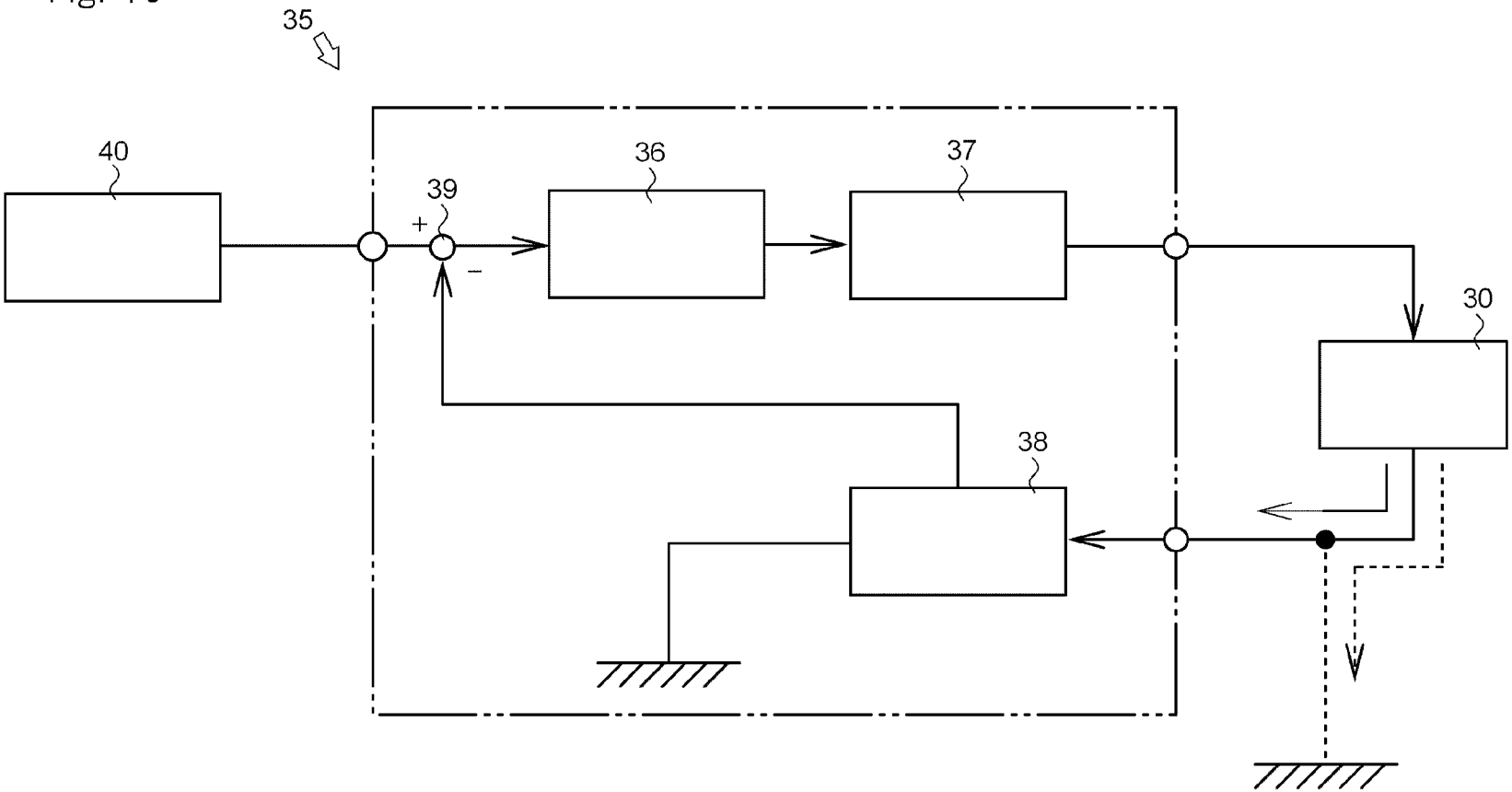
FIG. 19 is a schematic diagram of proofreading of a driver of the proportional electromagnetic valve.

The electromagnetic proportional valve 30 changes a flow direction of pressure oil of the steering hydraulic actuator 20. As shown in FIGS. 18 and 19, the electromagnetic proportional valve 30 includes mainly a valve body 31, a spool shaft 32, a first solenoid 33 and a second solenoid 34. In the valve body 31, the spool shaft 32 is provided slidably. The spool shaft 32 is slid in the valve body 31 so as to switch an oil passage of pressure oil. The first solenoid 33 slides the spool shaft 32 to one of sides. The second solenoid 34 slides the spool shaft 32 to the other side. In the electromagnetic proportional valve 30, current I is supplied from a driver 35 to the first solenoid 33 or the second solenoid 34. In this embodiment, the electromagnetic proportional valve 30 is a so-called direct acting type proportional electromagnetic valve. However, the electromagnetic proportional valve 30 may alternatively be a pilot type proportional electromagnetic valve and the operation type is not limited.

The driver 35 sends the current I to the electromagnetic proportional valve 30 based on a signal from the control device 40. As shown in FIG. 19, the driver 35 is configured by a PWM circuit (pulse width modulation circuit) 36, a proportional electromagnetic valve driving circuit 37 and a current detection circuit 38. The PWM circuit 36 can receive the control signal from the control device 40. The PWM circuit 36 can transmit a control pulse to the proportional electromagnetic valve driving circuit 37 based on the received control signal. The proportional electromagnetic valve driving circuit 37 can supply the current I to the electromagnetic proportional valve 30 based on the control pulse received from the PWM circuit 36. The current detection circuit 38 can be sent thereto with the current I supplied to the electromagnetic proportional valve 30. The current detection circuit 38 detects a current value from voltage reduction at a shunt resistor (not shown) to which the current I is sent. The current detection circuit 38 can input a current value, which is detected via a subtracter 39, to the PWM circuit 36. Namely, the driver 35 performs current feedback control based on deviation of the control signal and the current detection value.

As shown in FIG. 2, the control device 40 makes the control signal based on detection signals from the throttle lever 2, the steering wheel 3 and the joystick 4. The control device 40 transmits the control signal to the driver 35 of the electromagnetic proportional valve 30 and the like. The control device 40 can make the control signal based on information from the global positioning system (GPS) and can transmit the made control signal to the electromagnetic proportional valve 30 and the like. Namely, in addition to operation performed manually by an operator, the control device 40 can perform so-called automatic operation in which a route is calculated from its position and a set destination and the operation is performed automatically.

The control device 40 has an automatic proofreading function of the outdrive device 10 which is performed when the outdrive device 10 is attached to the hull 1. Concretely, the control device 40 can perform automatic proofreading in which connection confirmation and setting of movable range of the steering hydraulic actuator 20, propriety judgment of wiring of electric wires of the position sensor 26, propriety judgment of piping of hydraulic pipes of the electromagnetic proportional valve 30, presence judgment of short circuit failure of the control signal to the driver 35 of the electromagnetic proportional valve 30, and the like can be executed. Various programs, data and the like for executing the automatic proofreading are stored in the control device 40.

Concerning the ship 50 having the outdrive device 10 configured as the above, when the hull 1 is turned leftward, the control device 40 should slide the piston 22 of the steering hydraulic actuator 20 along a direction of an arrow L shown in FIGS. 16 and 17. Therefore, the control device 40 transmits the control signal to the electromagnetic proportional valve 30 so as to actuate the second solenoid 34. Accordingly, the second solenoid 34 slides the spool shaft 32 to a predetermined position. As a result, the piston 22 of the steering hydraulic actuator 20 is slid along the direction of the arrow L shown in FIGS. 16 and 17.

When the hull 1 is turned rightward, the control device 40 should slide the piston 22 of the steering hydraulic actuator 20 along a direction of an arrow R shown in FIGS. 16 and 17. Therefore, the control device 40 transmits the control signal to the electromagnetic proportional valve 30 so as to actuate the first solenoid 33. Accordingly, the first solenoid 33 slides the spool shaft 32 to a predetermined position. As a result, the piston 22 of the steering hydraulic actuator 20 is slid along the direction of the arrow R shown in FIGS. 16 and 17.

Operation mode of the automatic proofreading function of the outdrive device 10 of the ship 50 is explained.

As shown in FIGS. 1 and 16, when "proofreading execution" displayed on the monitor 8 is selected, the control device 40 actuates the piston 22 of the steering hydraulic actuator 20 configuring the outdrive device 10 and confirms the connection of the electric wires and the hydraulic pipes of the steering hydraulic actuator 20, the position sensor 26, the electromagnetic proportional valve 30 and the driver 35. Next, the control device 40 moves the piston 22 so as to set values of the position sensor 26 at the one end and the other end, and judges incorrect wiring of the electric wires and incorrect piping of the hydraulic pipes of the steering hydraulic actuator 20, the position sensor 26, the electromagnetic proportional valve 30 and the driver 35. Next, the control device 40 judges short circuit failure of a driving circuit of the electromagnetic proportional valve 30. Finally, the control device 40 sets a minimum current value Imin required for actuating the steering hydraulic actuator 20.

Next, control mode of the automatic proofreading of the control device 40 is explained concretely referring to FIGS. 20 to 24.

Figure 20:
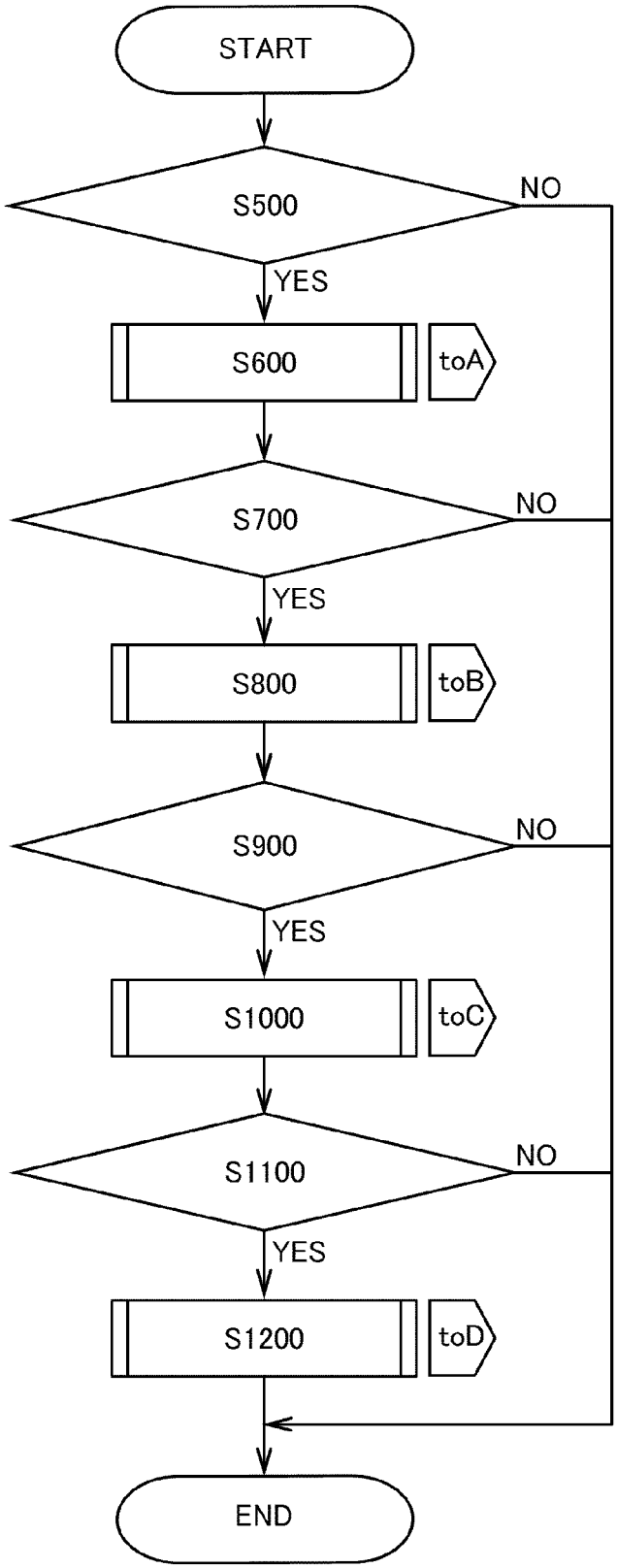
FIG. 20 is a diagram of control flow of proofreading of a ship having an automatic proofreading function.

As shown in FIG. 20, in a step S500, the control device 40 judges whether a proofreading signal caused by selecting "proofreading execution" displayed on the monitor 8 (see FIG. 1) is received or not.

As a result, when the proofreading signal is judged to be received, the control device 40 shifts to a step S600.

On the other hand, when the proofreading signal is judged not to be received, the control device 40 finishes control of the automatic proofreading.

Figure 21:
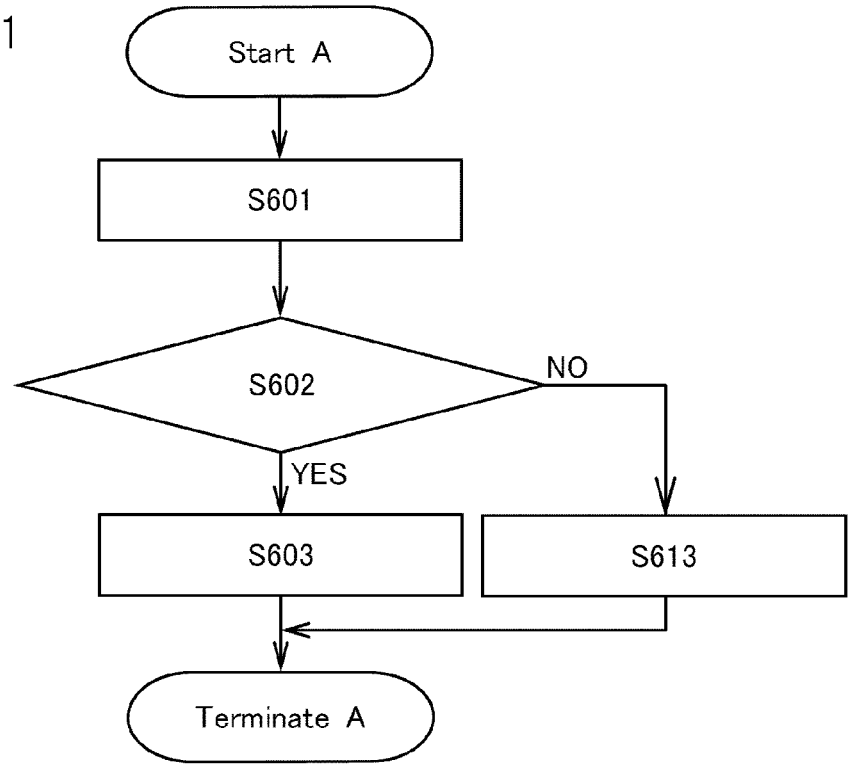
FIG. 21 is a diagram of control flow of connection confirmation control A of the ship having the automatic proofreading function.

In the step S600, the control device 40 starts connection confirmation control A and shifts to a step S601 (see FIG. 21). When the connection confirmation control A is finished, the control device 40 shifts to a step S700 (see FIG. 20).

In the step S700, the control device 40 judges whether connection failure exists in the electric wires or the hydraulic pipes or not based on the judgment result of the connection confirmation control A.

As a result, when the connection failure is judged not to exist in the electric wires and the hydraulic pipes, the control device 40 shifts to a step S800.

On the other hand, when the connection failure is judged to exist in the electric wires or the hydraulic pipes, the control device 40 finishes control of the automatic proofreading. In this case, the purport that the connection failure exists in the electric wires or the hydraulic pipes is displayed on the monitor 8.

Figure 22:
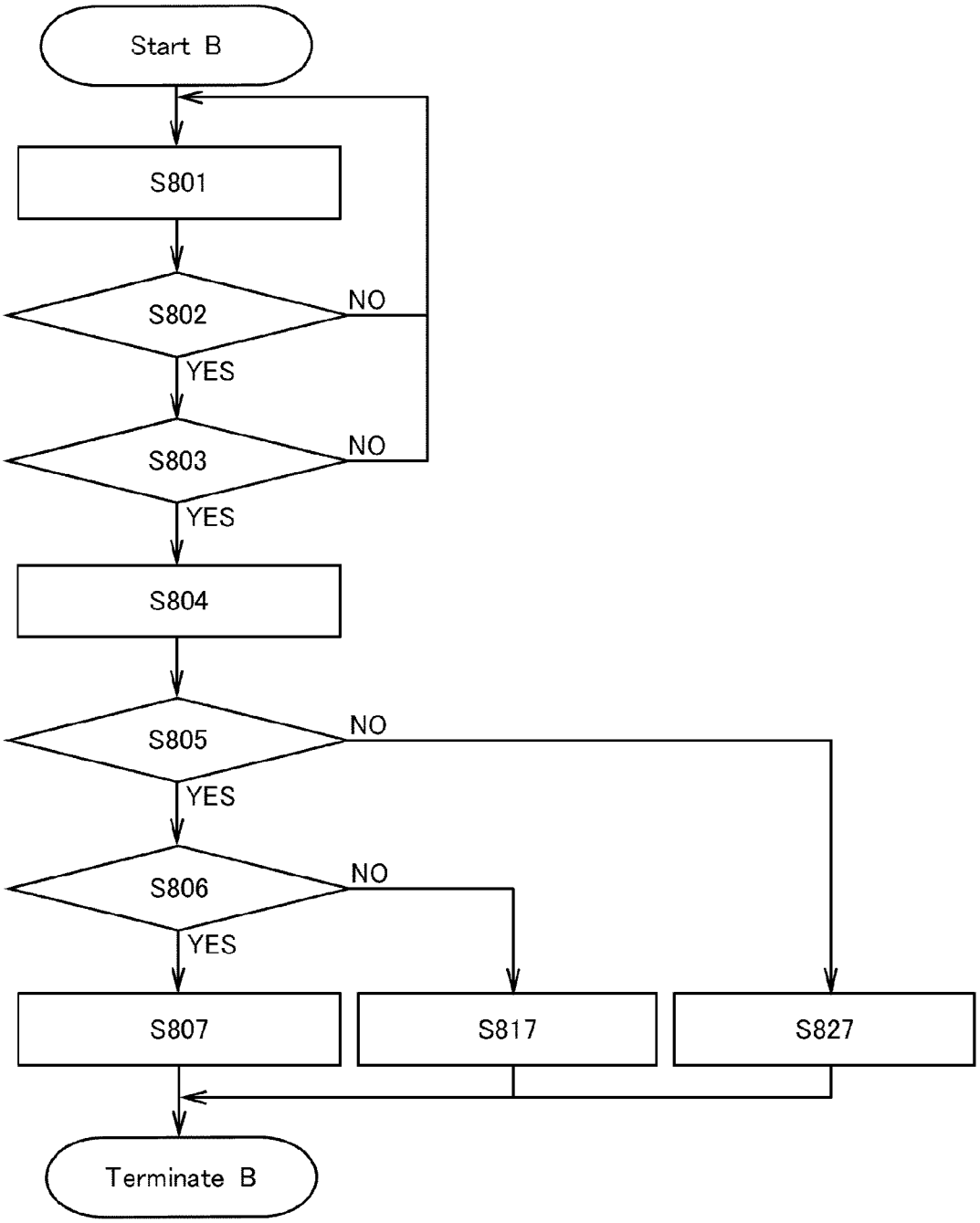
FIG. 22 is a diagram of control flow of actuator proofreading control B of the ship having the automatic proofreading function.

In the step S800, the control device 40 starts actuator collection control B and shifts to a step S801 (see FIG. 22). When the actuator collection control B is finished, the control device 40 shifts to a step S900 (see FIG. 20).

In the step S900, the control device 40 judges whether the incorrect wiring of the electric wires, the incorrect piping of the hydraulic pipes, or operation failure of the steering hydraulic actuator 20 exists or not based on the judgment result of the actuator collection control B.

As a result, when the incorrect wiring of the electric wires, the incorrect piping of the hydraulic pipes, and the operation failure of the steering hydraulic actuator 20 are judged not to exist, the control device 40 shifts to a step S1000.

On the other hand, when the incorrect wiring of the electric wires, the incorrect piping of the hydraulic pipes, or the operation failure of the steering hydraulic actuator 20 is judged to exist, the control device 40 finishes control of the automatic proofreading. In this case, the purport that the incorrect wiring of the electric wires, the incorrect piping of the hydraulic pipes, or the operation failure of the steering hydraulic actuator 20 exists is displayed on the monitor 8.

Figure 23:
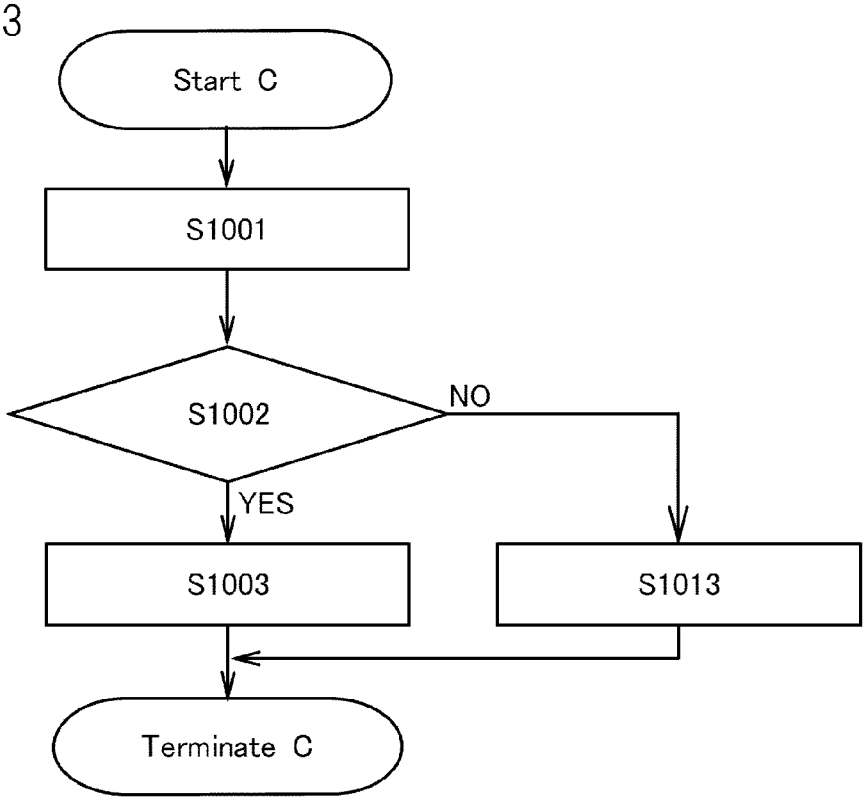
FIG. 23 is a diagram of control flow of short circuit failure confirmation control C of the ship having the automatic proofreading function.

In the step S1000, the control device 40 starts short circuit failure confirmation control C and shifts to a step S1001 (see FIG. 23). When the short circuit failure confirmation control C is finished, the control device 40 shifts to a step S1100 (see FIG. 20).

In the step S1100, the control device 40 judges whether the short circuit failure of the driving circuit of the electromagnetic proportional valve 30 exists or not based on the judgment result of the short circuit failure confirmation control C.

As a result, when the short circuit failure of the driving circuit of the electromagnetic proportional valve 30 is judged not to exist, the control device 40 shifts to a step S1200.

On the other hand, when the short circuit failure of the driving circuit of the electromagnetic proportional valve 30 is judged to exist, the control device 40 finishes control of the automatic proofreading. In this case, the purport that the short circuit failure of the driver 35 exists is displayed on the monitor 8.

Figure 24:
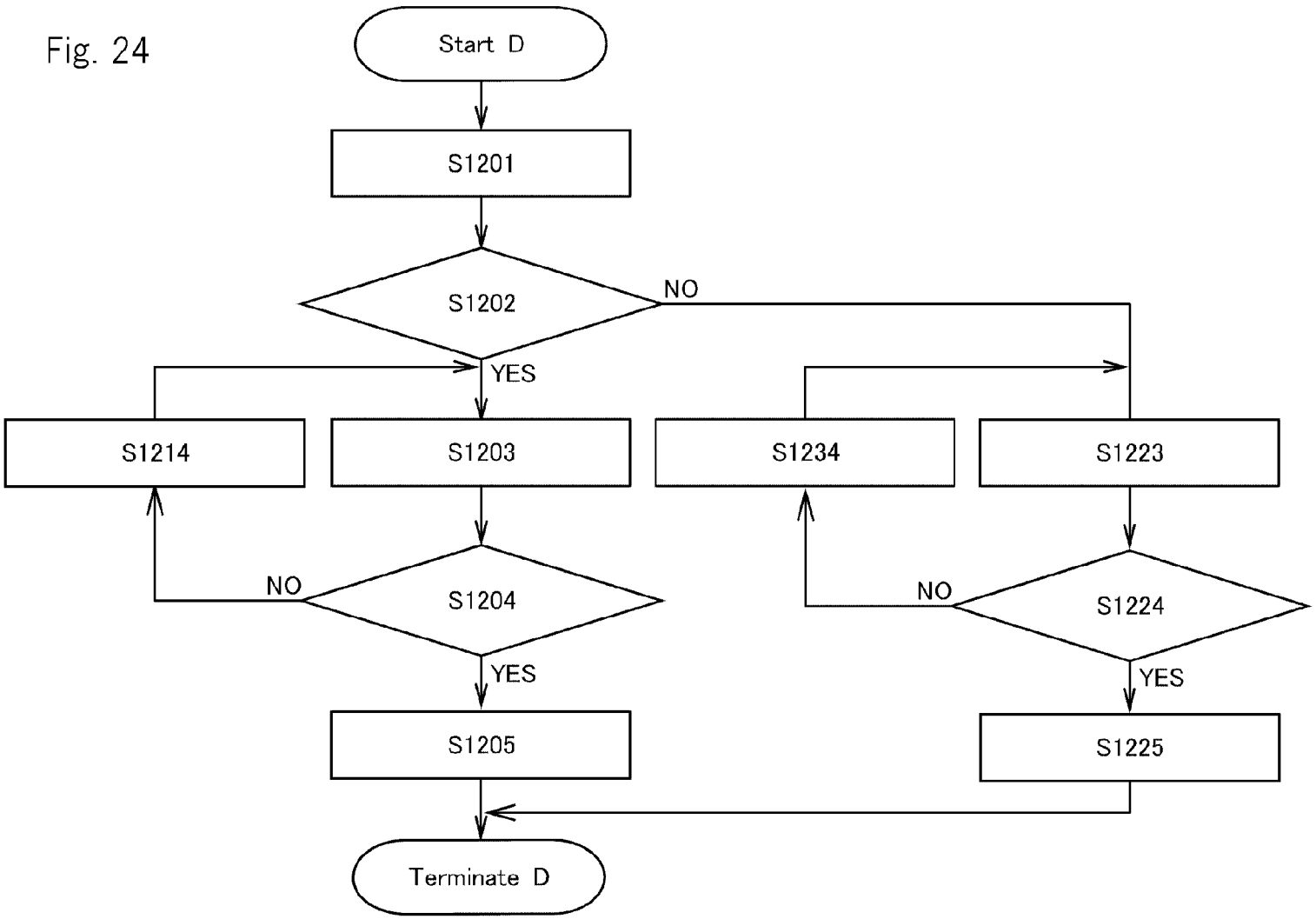
FIG. 24 is a diagram of control flow of driver proofreading control D of the ship having the automatic proofreading function.

In the step S1200, the control device 40 starts driver proofreading control D and shifts to a step S1201 (see FIG. 24). When the driver proofreading control D is finished, the control device 40 finishes control of the automatic proofreading (see FIG. 20). Namely, when the operation failure, the incorrect piping, the failure or the like is judged to exist in the connection confirmation control A, the actuator collection control B, the short circuit failure confirmation control C and the driver proofreading control D, the control device 40 finishes control of the automatic proofreading.

As shown in FIG. 21, in the step S601 of the connection confirmation control A, the control device 40 actuates the steering hydraulic actuator 20 along a predetermined direction and shifts to a step S602. Concretely, the control device 40 switches a direction of pressure oil by the electromagnetic proportional valve 30 so as to move the piston 22 of the steering hydraulic actuator 20 for a predetermined amount Sv toward one side, the other side and the one side in this order, and shifts to a step S602.

In the step S602, the control device 40 judges whether a detection value P of the position sensor 26 is changed for not less than a predetermined value Pv following the operation of the steering hydraulic actuator 20 or not.

As a result, when the detection value P of the position sensor 26 is judged to be changed for not less than the predetermined value Pv, the control device 40 shifts to a step S603.

On the other hand, when the detection value P of the position sensor 26 is judged not to be changed for not less than the predetermined value Pv, the control device 40 shifts to a step S613.

In the step S603, the control device 40 judges that the connection failure does not exist in the electric wires or the hydraulic pipes, and finishes the connection confirmation control A. Concretely, the control device 40 judges that the connection failure of the electric wires concerning the position sensor 26, the electromagnetic proportional valve 30 and the driver 35 and the connection failure of the hydraulic pipes concerning the steering hydraulic actuator 20 do not exist, and finishes the connection confirmation control A.

In the step S613, the control device 40 judges that the connection failure exists in the electric wires or the hydraulic pipes, and finishes the connection confirmation control A. Concretely, the control device 40 judges that the connection failure of the electric wires concerning the position sensor 26, the electromagnetic proportional valve 30 and the driver 35 or the connection failure of the hydraulic pipes concerning the steering hydraulic actuator 20 exist, and finishes the connection confirmation control A.

As shown in FIG. 22, in the step S801 of the actuator collection control B, the control device 40 moves the piston 22 of the steering hydraulic actuator 20 toward the one side and the other side, and shifts to a step S802.

In the step S802, the control device 40 judges whether the detection value P of the position sensor 26 at the time of moving the piston 22 of the steering hydraulic actuator 20 toward the one side or the other side is within a first proofreading range R1 or a second proofreading range R2 or not.

As a result, when the detection value P is judged to be within the first proofreading range R1 or the second proofreading range R2, the control device 40 shifts to a step S803.

On the other hand, when the detection value P is judged not to be within the first proofreading range R1 or the second proofreading range R2, the control device 40 shifts to the step S801.

In the step S803, the control device 40 judges whether the detection value P of the position sensor 26 at the time of moving the piston 22 of the steering hydraulic actuator 20 toward the one side or the other side is detected continuously for a predetermined time t1 or not.

As a result, when the detection value P is judged to be detected continuously for the predetermined time t1, the control device 40 shifts to a step S804.

On the other hand, when the detection value P is judged not to be detected continuously for the predetermined time t1, the control device 40 shifts to the step S801.

In the step S804, the control device 40 sets a detection value P1 of the position sensor 26 at the time of moving the piston 22 of the steering hydraulic actuator 20 toward the one side as a position at one of end (hereinafter, simply referred to as "one end position P1"), sets a detection value P2 of the position sensor 26 at the time of moving the piston 22 of the steering hydraulic actuator 20 toward the other side as a position at the other end (hereinafter, simply referred to as "the other end position P2"), and shifts to a step S805. In this embodiment, the detection value P of the position sensor 26 is increased following movement of the piston 22 to one of sides of the steering hydraulic actuator 20.

In the step S805, the control device 40 judges whether the one end position P1 is larger than the other end position P2 or not.

As a result, when the one end position P1 is judged to be larger than the other end position P2, the control device 40 shifts to a step S806.

On the other hand, when the one end position P1 is judged to be not more than the other end position P2, the control device 40 shifts to a step S827.

In the step S806, the control device 40 judges whether difference of the one end position P1 and the other end position P2 is not less than a predetermined value Lv or not. As a result, when the difference of the one end position P1 and the other end position P2 is judged not to be less than the predetermined value Lv, the control device 40 shifts to a step S807.

On the other hand, when the difference of the one end position P1 and the other end position P2 is judged to be less than the predetermined value Lv, the control device 40 shifts to a step S817. In this embodiment, the predetermined value Lv is a standard stroke of the steering hydraulic actuator 20.

In the step S807, the control device 40 judges that the incorrect wiring, the incorrect piping and the operation failure do not exist and finishes the actuator collection control B. Concretely, the control device 40 judges that the connection failure of the electric wires concerning the position sensor 26, the electromagnetic proportional valve 30 and the driver 35, the connection failure of the hydraulic pipes concerning the steering hydraulic actuator 20, and the operation failure of the steering hydraulic actuator 20 do not exist, and finishes the actuator collection control B.

In the step S817, the control device 40 judges as the operation failure, and finishes the actuator collection control B. Concretely, the control device 40 judges as the operation failure of the steering hydraulic actuator 20, and finishes the actuator collection control B.

In the step S827, the control device 40 judges that the incorrect wiring or the incorrect piping exists, and finishes the actuator collection control B. Concretely, the control device 40 judges that the connection failure of the electric wires concerning the position sensor 26, the electromagnetic proportional valve 30 and the driver 35, or the connection failure of the hydraulic pipes concerning the steering hydraulic actuator 20 exists, and finishes the actuator collection control B.

As shown in FIG. 23, in the step S1001 of the short circuit failure confirmation control C, the control device 40 sends current I0 whose magnitude is not enough to operate the electromagnetic proportional valve 30 from the driver 35 to the electromagnetic proportional valve 30, and shifts to a step S1002.

In the step S1002, the control device 40 judges whether the detection value P of the position sensor 26 is changed or not. Namely, the control device 40 judges whether the electromagnetic proportional valve 30 is operated by the current I from the driver 35 or not.

As a result, when the detection value P of the position sensor 26 is judged not to be changed, that is, when it is judged that the current I sent from the driver 35 to the electromagnetic proportional valve 30 is the current I0 and the electromagnetic proportional valve 30 is not operated, the control device 40 shifts to a step S1003.

On the other hand, when the detection value P of the position sensor 26 is judged to be changed, that is, when it is judged that the current I sent from the driver 35 to the electromagnetic proportional valve 30 is larger than the current I0 and the electromagnetic proportional valve 30 is operated, the control device 40 shifts to a step S1013.

In the step S1003, the control device 40 judges that the short circuit failure of the driving circuit of the electromagnetic proportional valve 30 does not exist, and finishes the short circuit failure confirmation control C. Concretely, the control device 40 judges that a current value detected by the current detection circuit 38 of the driver 35 is the same as a current value of the current I0 and the short circuit failure of the driving circuit of the electromagnetic proportional valve 30 does not exist, and finishes the short circuit failure confirmation control C.

In the step S1013, the control device 40 judges that the short circuit failure of the driving circuit of the electromagnetic proportional valve 30 exists, and finishes the short circuit failure confirmation control C. Concretely, as shown in FIG. 19, when the short circuit failure of the driving circuit of the electromagnetic proportional valve 30 to a GND occurs, a part of the current I sent from the electromagnetic proportional valve 30 to the current detection circuit 38 (see an arrow of a solid line in FIG. 19) is sent to the GND (see an arrow of a dashed line in FIG. 19). As a result, the current value detected by the current detection circuit 38 becomes smaller than the current value of the current I0. The driver 35 judges that the current I sent to the electromagnetic proportional valve 30 is smaller than the current I0, and increases the current value of the current I supplied to the electromagnetic proportional valve 30 by the current feedback control. By operating the electromagnetic proportional valve 30 by the increased current I, the steering hydraulic actuator 20 is operated. Namely, the control device 40 judges that the short circuit failure of the driving circuit of the electromagnetic proportional valve 30 occurs by changing the detection value P of the position sensor 26, and finishes the short circuit failure confirmation control C.

As shown in FIG. 24, in the step S1201 of the driver proofreading control D, the control device 40 sends a current I(n) from the driver 35 to the electromagnetic proportional valve 30 for a predetermined time, and shifts to a step S1202.

In the step S1202, the control device 40 judges whether the detection value P of the position sensor 26 is changed or not. Namely, the control device 40 judges whether a current value of the current I(n) from the driver 35 is not less than a minimum current value Imin driving the electromagnetic proportional valve 30 or not.

As a result, when the detection value P of the position sensor 26 is judged to be changed, namely, when the current value of the current I(n) from the driver 35 is judged not to be less than the minimum current value Imin driving the electromagnetic proportional valve 30, the control device 40 shifts to a step S1203.

On the other hand, when the detection value P of the position sensor 26 is judged not to be changed, the control device 40 shifts to a step S1223.

In the step S1203, the control device 40 sends a current I(n+1) whose current value is smaller for a predetermined value Iv than that of the current I(n) sent from the driver 35 to the electromagnetic proportional valve 30, and shifts to a step S1204.

In the step S1204, the control device 40 judges whether the detection value P of the position sensor 26 is not changed or not.

As a result, when the detection value P of the position sensor 26 is judged not to be changed, the control device 40 shifts to a step S1205.

On the other hand, when the detection value P of the position sensor 26 is judged to be changed, the control device 40 shifts to a step S1214.

In the step S1205, the control device 40 sets the minimum current value Imin as the current value of the current I(n), and finishes the driver proofreading control D.

In the step S1214, the control device 40 shifts to the step S1203 so as to make n of the current I(n) be n=n+1, that is, set the current I(n+1) whose current value is smaller for the predetermined value Iv than that of the current I(n) as the current I(n), thereby reducing a current value of the new current I(n) for the predetermined value Iv.

In the step S1223, the control device 40 sends the current I(n+1) whose current value is larger for the predetermined value Iv than that of the current I(n) sent from the driver 35 to the electromagnetic proportional valve 30, and shifts to the step S1204.

In a step S1224, the control device 40 judges whether the detection value P of the position sensor 26 is not changed or not.

As a result, when the detection value P of the position sensor 26 is judged to be changed, the control device 40 shifts to a step S1225.

On the other hand, when the detection value P of the position sensor 26 is judged not to be changed, the control device 40 shifts to a step S1234.

In the step S1225, the control device 40 sets the current value of the current I(n+1) as the minimum current value Imin, and finishes the driver proofreading control D.

In the step S1234, the control device 40 shifts to the step S1223 so as to make n of the current I(n) be n=n+1, that is, set the current I(n+1) whose current value is smaller for the predetermined value Iv than that of the current I(n) as the current I(n), thereby increasing a current value of the new current I(n) for the predetermined value Iv.

Relation of the automatic proofreading function and steering control in control mode of the outdrive device 10 of the ship 50 is explained.

When a control signal of the outdrive device 10 is received, the control device 40 judges whether a proofreading starting signal has been received by that time or not. When the proofreading starting signal has been already received and the proofreading is being performed or not finished completely, the control device 40 repeals the control signal of the outdrive device 10. On the other hand, when the proofreading starting signal has been not already received and the proofreading has been finished completely, the control device 40 repeals the proofreading starting signal.

Figure 25:
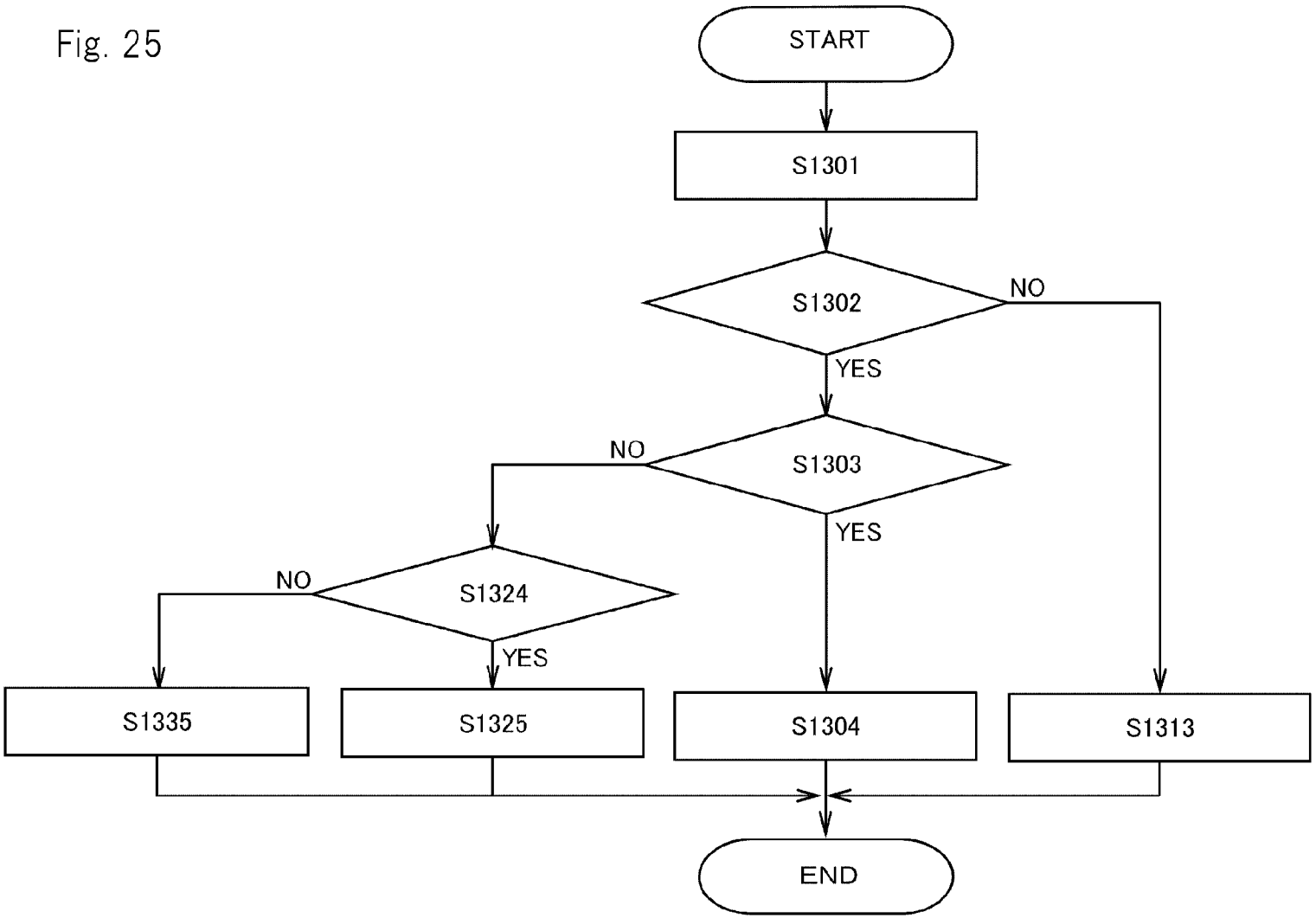
FIG. 25 is a diagram of control flow of relation of steering control and the automatic proofreading function of the ship having the automatic proofreading function.

Next, the relation of the automatic proofreading function and steering control in control mode of the control device 40 is explained referring to FIG. 25.

As shown in FIG. 25, in a step S1301, when the control signal of the outdrive device 10 is received, the control device 40 shifts to a step S1302.

In the step S1302, the control device 40 judges whether the proofreading starting signal of the outdrive device 10 has been received or not.

As a result, when the proofreading starting signal of the outdrive device 10 is judged to have been received, the control device 40 shifts to a step S1303.

On the other hand, when the proofreading starting signal of the outdrive device 10 is judged not to have been received, the control device 40 shifts to a step S1313.

In the step S1303, the control device 40 judges whether the proofreading of the outdrive device 10 is being performed or not.

As a result, when the proofreading of the outdrive device 10 is judged to be being performed, the control device 40 shifts to a step S1304.

On the other hand, when the proofreading of the outdrive device 10 is judged not to be being performed, the control device 40 shifts to a step S1324.

In the step S1304, the control device 40 repeals the control signal of the outdrive device 10 and continues the control of the automatic proofreading. Namely, the ship 50 having the automatic proofreading function of this embodiment is configured so that the control of the outdrive device 10 cannot be performed when the proofreading of the outdrive device 10 is being performed.

In the step S1313, the control device 40 repeals the control signal of the outdrive device 10. Namely, the ship 50 having the automatic proofreading function of this embodiment is configured so that the control of the outdrive device 10 cannot be performed when the proofreading of the outdrive device 10 is not performed.

In the step S1324, the control device 40 judges whether the proofreading of the outdrive device 10 is finished or not.

As a result, when the proofreading of the outdrive device 10 is judged to be finished, the control device 40 shifts to a step S1325.

On the other hand, when the proofreading of the outdrive device 10 is judged not to be finished, the control device 40 shifts to a step S1335.

In the step S1325, the control device 40 repeals the proofreading starting signal of the outdrive device 10 and continues the control of the outdrive device 10. Namely, the ship 50 having the automatic proofreading function of this embodiment is configured so that the proofreading of the outdrive device 10 cannot be performed while the control of the outdrive device 10 is performed when the proofreading of the outdrive device 10 is finished.

In the step S1335, the control device 40 repeals the control signal of the outdrive device 10 and continues the control of the automatic proofreading. Namely, the ship 50 having the automatic proofreading function of this embodiment is configured so that the control of the outdrive device 10 cannot be performed when the proofreading of the outdrive device 10 is not finished.

As the above, the ship 50 having the automatic proofreading function is the ship 50 having the outdrive device 10 steering by the steering hydraulic actuator 20, and has the position sensor 26 which is a piston position detection device of the steering hydraulic actuator 20, the electromagnetic proportional valve 30 switching the direction of pressure oil, and the control device 40 controlling the electromagnetic proportional valve 30. Operation confirmation of the steering hydraulic actuator 20 and the electromagnetic proportional valve 30, setting of the movable range of the steering hydraulic actuator 20, and setting of the electromagnetic proportional valve 30 are performed automatically by the control device 40 as the proofreading of the outdrive device 10. When the steering hydraulic actuator 20 and the electromagnetic proportional valve 30 are not operated normally, the proofreading of the outdrive device 10 is stopped.

According to the configuration, an operator does not need to execute manually and visually the proofreading of the outdrive device 10. When abnormality exists, the proofreading of the outdrive device 10 is stopped. Accordingly, even when the steering hydraulic actuator 20 and the like cannot be confirmed visually, the proofreading of the outdrive device 10 can be executed certainly while suppressing variation.

When the detection value P of the position sensor 26 is not changed for not less than the predetermined value Pv in the case in which the piston 22 of the steering hydraulic actuator 20 is moved for the predetermined amount Sv toward one side and the other side by the control device 40, the proofreading of the outdrive device 10 is stopped. According to the configuration, regardless of the piston position of the steering hydraulic actuator 20, abnormality of the steering hydraulic actuator 20, abnormality of the electromagnetic proportional valve 30 and abnormality of the position sensor 26 are judged at once. Accordingly, even when the steering hydraulic actuator 20 and the like cannot be confirmed visually, the proofreading of the outdrive device 10 can be executed certainly while suppressing variation.

After operation confirmation of the steering hydraulic actuator 20 is judged to be normal by the control device 40, when the piston 22 is moved to the one side of the steering hydraulic actuator 20 and the position sensor 26 outputs the detection value P1 within the first proofreading range R1 for the predetermined time t1, the piston 22 is judged to reach the one end of the steering hydraulic actuator 20. When the piston 22 is moved to the other side of the steering hydraulic actuator 20 and the position sensor 26 outputs the detection value P2 within the second proofreading range R2 for the predetermined time t1, the piston 22 is judged to reach the other end of the steering hydraulic actuator 20 and the movable range of the steering hydraulic actuator 20 is set. When the position sensor 26 does not output the detection value P1 within the first proofreading range R1 and/or the detection value P2 within the second proofreading range R2 for the predetermined time t1, or the difference of the detection value P1 within the first proofreading range R1 and the detection value P2 within the second proofreading range R2 is not more than the predetermined value Lv, the proofreading of the outdrive device 10 is stopped.

According to the configuration, a stroke end of the steering hydraulic actuator 20 is detected by using the position sensor 26, whereby excessive hydraulic load is not applied to the outdrive device 10. Accordingly, even when the steering hydraulic actuator 20 and the like cannot be confirmed visually, the proofreading of the outdrive device 10 can be executed certainly while suppressing variation.

When the current I0 whose magnitude is not enough to operate the electromagnetic proportional valve 30 is sent from the driver 35 having the proportional electromagnetic valve driving circuit to the electromagnetic proportional valve 30 by the control device 40 and the detection value P of the position sensor 26 is changed, the short circuit failure is judged to exist in the driving circuit of the electromagnetic proportional valve 30 and the proofreading of the outdrive device 10 is stopped.

According to the configuration, the short circuit failure in the driving circuit of the electromagnetic proportional valve 30 can be detected by using the position sensor 26. Accordingly, even when the steering hydraulic actuator 20 and the like cannot be confirmed visually, the proofreading of the outdrive device 10 can be executed certainly while suppressing variation.

After the short circuit failure is judged not to exist in the driving circuit of the electromagnetic proportional valve 30 by the control device 40, the current value of the current I(n) send from the driver 35 having the proportional electromagnetic valve driving circuit to the electromagnetic proportional valve 30 is changed, and the minimum current value of the current I(n) in which the detection value P of the position sensor 26 is changed is set as the minimum current value Imin.

According to the configuration, the minimum current value Imin of the electromagnetic proportional valve 30 is set by using the position sensor 26. Accordingly, even when the steering hydraulic actuator 20 and the like cannot be confirmed visually, the proofreading of the outdrive device 10 can be executed certainly while suppressing variation.

The ship 50 having the automatic proofreading function is the ship 50 having the outdrive device 10 steering by the steering hydraulic actuator 20, and has the electromagnetic proportional valve 30 which is an electromagnetic valve switching the direction of pressure oil, and the control device 40 controlling the electromagnetic proportional valve 30. The control device 40 controls the electromagnetic proportional valve 30 so as to execute the proofreading of the outdrive device 10 and repeals the control signal to the outdrive device 10 inputted while the proofreading is executed.

According to the configuration, the outdrive device 10 is not operated before and under the execution of the proofreading of the outdrive device 10. Accordingly, the operation of the outdrive device 10 before finishing the proofreading can be prevented so as to suppress incorrect operation of the outdrive device 10.

When the proofreading of the outdrive device 10 is not finished normally, the control device 40 repeals the control signal to the outdrive device 10.

According to the configuration, when the proofreading of the outdrive device 10 is finished abnormally, the outdrive device 10 is not operated. Accordingly, the operation of the outdrive device 10 before finishing the proofreading can be prevented so as to suppress incorrect operation of the outdrive device 10.

The control device 40 repeals the control signal to the outdrive device 10 inputted while the outdrive device 10 is controlled.

According to the configuration, the proofreading of the outdrive device 10 is not executed while the outdrive device 10 is controlled. Accordingly, the operation of the outdrive device 10 before finishing the proofreading can be prevented so as to suppress incorrect operation of the outdrive device 10.

When the proofreading of the outdrive device 10 is executed after the proofreading of the outdrive device 10 is finished normally, the control device 40 repeals the control signal to the outdrive device 10 until the proofreading of the outdrive device 10 is finished normally.

According to the configuration, even when the proofreading is executed again because of exchange of parts or the like, the outdrive device 10 is not operated until the proofreading is finished normally. Accordingly, the operation of the outdrive device 10 before finishing the proofreading of the outdrive device 10 can be prevented so as to suppress incorrect operation of the outdrive device 10.

INDUSTRIAL APPLICABILITY

The present invention can be used for an art of a ship steering system for an outdrive device.

DESCRIPTION OF NOTATIONS

1 hull
2 throttle lever
3 steering wheel
4 operation lever (joystick)
5 engine
8 monitor
10 outdrive device
20 steering hydraulic actuator
30 electromagnetic proportional valve
40 control device
82 operation instruction part
82*a* icon
82*b* icon
100 ship steering system for outdrive device

The invention claimed is:

1. A ship steering system for an outdrive device comprising:

the outdrive device;

a control device instructing a rotation direction of the outdrive device;

an operation lever instructing a traveling direction of a hull to the control device; and a monitor which can display an image for adjusting an actual traveling direction to the traveling direction of the hull instructed by the operation lever, characterized in that the monitor shows a direction along which the operation lever is moved, and when the direction along which the operation lever is moved is in agreement with a direction set preferably, shows an indication that the operation is proper.

2. The ship steering system for the outdrive device according to claim 1, wherein the monitor shows a direction along which the operation lever should be moved, and when the operation lever is moved to the shown direction, shows the indication that the operation is proper.

3. The ship steering system for the outdrive device according to claim 2, wherein the monitor shows a direction along which the operation lever should be moved by a range of predetermined angle centering on a fulcrum of the operation lever, and when the operation lever is moved along the shown range, shows the indication that the operation is proper.

4. The ship steering system for the outdrive device according to claim 2, wherein when a gap exists between the traveling direction of the hull instructed by the operation lever and the actual traveling direction, the monitor shows the direction along which the operation lever should be moved which is collected so as to cancel the gap.

5. The ship steering system for the outdrive device according to claim 1, wherein when a gap exists between the traveling direction of the hull instructed by the operation lever and the actual traveling direction, the monitor collects the rotation direction of the outdrive device so as to cancel the gap and shows the indication that the collection is finished.

6. The ship steering system for the outdrive device according to claim 1, wherein the monitor shows the image of parallel movement, and subsequently shows the image of skid movement.

7. The ship steering system for the outdrive device according to claim 3, wherein when a gap exists between the traveling direction of the hull instructed by the operation lever and the actual traveling direction, the monitor shows the direction along which the operation lever should be moved which is collected so as to cancel the gap.

8. The ship steering system for the outdrive device according to claim 2, wherein when a gap exists between the traveling direction of the hull instructed by the operation lever and the actual traveling direction, the monitor collects the rotation direction of the outdrive device so as to cancel the gap and shows the indication that the collection is finished.

9. The ship steering system for the outdrive device according to claim 3, wherein when a gap exists between the traveling direction of the hull instructed by the operation lever and the actual traveling direction, the monitor collects the rotation direction of the outdrive device so as to cancel the gap and shows the indication that the collection is finished.

10. The ship steering system for the outdrive device according to claim 4, wherein when a gap exists between the traveling direction of the hull instructed by the operation lever and the actual traveling direction, the monitor collects the rotation direction of the outdrive device so as to cancel the gap and shows the indication that the collection is finished.

11. The ship steering system for the outdrive device according to claim 7, wherein when a gap exists between the traveling direction of the hull instructed by the operation lever and the actual traveling direction, the monitor collects the rotation direction of the outdrive device so as to cancel the gap and shows the indication that the collection is finished.

12. The ship steering system for the outdrive device according to claim 2, wherein the monitor shows the image of parallel movement, and subsequently shows the image of skid movement.

13. The ship steering system for the outdrive device according to claim 3, wherein the monitor shows the image of parallel movement, and subsequently shows the image of skid movement.

14. The ship steering system for the outdrive device according to claim 4, wherein the monitor shows the image of parallel movement, and subsequently shows the image of skid movement.

15. The ship steering system for the outdrive device according to claim 5, wherein the monitor shows the image of parallel movement, and subsequently shows the image of skid movement.

16. The ship steering system for the outdrive device according to claim 7, wherein the monitor shows the image of parallel movement, and subsequently shows the image of skid movement.

17. The ship steering system for the outdrive device according to claim 8, wherein the monitor shows the image of parallel movement, and subsequently shows the image of skid movement.

18. The ship steering system for the outdrive device according to claim 9, wherein the monitor shows the image of parallel movement, and subsequently shows the image of skid movement.

19. The ship steering system for the outdrive device according to claim 10, wherein the monitor shows the image of parallel movement, and subsequently shows the image of skid movement.

20. The ship steering system for the outdrive device according to claim 11, wherein the monitor shows the image of parallel movement, and subsequently shows the image of skid movement.

* * * * *